US007896752B2

(12) United States Patent
Yule

(10) Patent No.: US 7,896,752 B2
(45) Date of Patent: Mar. 1, 2011

(54) AMUSEMENT RIDE SYSTEM

(76) Inventor: Lance Yule, Portland, ME (US)

( * ) Notice: Subject to any disclaimer, the term of this patent is extended or adjusted under 35 U.S.C. 154(b) by 576 days.

(21) Appl. No.: 11/936,199

(22) Filed: Nov. 7, 2007

(65) Prior Publication Data

US 2009/0118024 A1 May 7, 2009

(51) Int. Cl.
*A63H 23/02* (2006.01)
*A63H 23/00* (2006.01)

(52) U.S. Cl. ..... 472/129; 472/134; 104/23.2

(58) Field of Classification Search ..... 472/134, 472/135, 13, 128, 129; 104/23.2; 180/117–118, 180/123–124
See application file for complete search history.

(56) References Cited

U.S. PATENT DOCUMENTS

| | | | | |
|---|---|---|---|---|
| 2,174,716 | A | 10/1939 | Bethell | |
| 3,142,285 | A | 7/1964 | Sorrentino et al. | |
| 3,251,595 | A | 5/1966 | Morgan et al. | |
| 3,889,602 | A * | 6/1975 | Barber | 104/23.2 |
| 4,292,758 | A | 10/1981 | Kuma et al. | |
| 4,896,610 | A * | 1/1990 | Denne | 104/23.2 |
| 6,045,449 | A | 4/2000 | Aragona et al. | |
| 6,115,974 | A | 9/2000 | Milanian | |
| 7,306,066 | B2 * | 12/2007 | Trojahn | 180/117 |
| 2006/0169508 | A1 | 8/2006 | Trojahn | |

FOREIGN PATENT DOCUMENTS

| | | |
|---|---|---|
| GB | 0 252 752 | 1/1988 |

OTHER PUBLICATIONS

Communication from foreign associate in corresponding application, dated Feb. 24, 2009.

* cited by examiner

*Primary Examiner* — Kien T Nguyen
(74) *Attorney, Agent, or Firm* — Fish & Richardson P.C.

(57) ABSTRACT

An amusement ride system includes an amusement ride infrastructure defining a travel surface, with at least one vehicle having a vehicle body defining a vehicle undersurface disposed for travel generally along the travel surface. A plurality of valves are disposed to selectively deliver a pressurized flow of water through the travel surface, into a confined region defined between the vehicle undersurface and the travel surface, the pressurized flow of water into and through the confined region creating a cushion of water to separate the vehicle undersurface from the travel surface. The vehicle is configured to convey at least one passenger generally along the travel surface upon the cushion of water.

28 Claims, 17 Drawing Sheets

AMUSEMENT RIDE SYSTEM

TECHNICAL FIELD

This disclosure relates to amusement ride systems, and, in particular to amusement ride systems having fluid-supported vehicles.

BACKGROUND

Amusement rides may include vehicles or other devices for transporting people over water. These amusement ride systems generally include watercraft vehicles designed to float along with or upon a confined body of water, transporting one or more passengers. The body of water may be stationary or moving. For example, in a log flume amusement ride, a vehicle resembling a log moves along a narrow, flowing channel of water. The watercraft vehicles may also have the form of bumper boats, consisting of an inner-tube shaped watercraft, with steerable gas or electric motor, that drivers try to ram into other boats as they travel past.

SUMMARY

According to one aspect, an amusement ride system includes an amusement ride infrastructure defining a travel surface; at least one vehicle having a vehicle body defining a vehicle undersurface disposed for travel generally along the travel surface; and a plurality of supply valves disposed to selectively deliver a pressurized flow of water through the travel surface, into a confined region defined between the vehicle undersurface and the travel surface. The pressurized flow of water into and through the confined region creates a cushion of water to separate the vehicle undersurface from the travel surface. The vehicle is configured to convey at least one passenger generally along the travel surface, upon the cushion of water.

In another aspect, an amusement ride vehicle for maneuvering over a travel surface having a cushion of water includes a vehicle body defining a vehicle undersurface disposed for travel generally along the travel surface. A reservoir is defined by a lower portion of the vehicle body. The vehicle undersurface defines at least one aperture in fluid communication with the reservoir, so that fluid from the cushion of water enters the reservoir through the aperture. At least one drive assembly is housed by the vehicle body and configured to maneuver the vehicle generally along the travel surface.

In yet another aspect, an amusement ride infrastructure includes a surface layer defining a travel surface and a plurality of supply valves disposed in the surface layer. Each supply valve includes a supply valve body defining an exit port, at least one inlet port, and an interior surface defining a water flow passageway between the at least one inlet port and the exit port and a valve seat. The exit port is exposed at the travel surface. A supply valve element is disposed within the water flow passageway for movement between a first position in sealing engagement with the valve seat and a second position spaced from the valve seat for permitting pressurized flow of water through the exit port. A supply valve element operator extends above a plane of the travel surface in a position for contact with a vehicle passing over the exit port. Vehicle contact with the supply valve element operator causes movement of the supply valve element from the first position to the second position, permitting pressurized flow of water through the exit port into a confined region defined between an undersurface of the vehicle and the travel surface.

In another aspect, a method of conveying an amusement ride vehicle generally along a travel surface includes placing the vehicle on an amusement ride infrastructure defining the travel surface. The vehicle includes a vehicle body that defines a vehicle undersurface disposed for travel generally along the travel surface. The method includes delivering a pressurized flow of water through the travel surface into a confined region defined between the vehicle undersurface and the travel surface. The pressurized flow of water into and through the confined region creates a cushion of water to separate the vehicle undersurface from the travel surface. The method also includes maneuvering the vehicle over the travel surface. In some implementations, the pressurized flow of water is delivered through a plurality of selectively disposed valves.

Implementations of the disclosure may include one of more of the following features. Each supply valve includes a supply valve body defining an exit port, at least one inlet port, and an interior surface defining a water flow passageway between the at least one inlet port and the exit port and a valve seat, with the exit port being exposed at the travel surface. A supply valve element is disposed within the water flow passageway for movement between a first position in sealing engagement with the valve seat and a second position spaced from the valve seat for permitting pressurized flow of water through the exit port. A supply valve element operator extends above a plane of the travel surface in a position for contact with a vehicle passing over the exit port. Vehicle contact with the supply valve element operator causes movement of the supply valve element from the first position to the second position, permitting pressurized flow of water through the exit port into the confined region defined between the vehicle undersurface and the travel surface. The valve element is urged toward sealing engagement with the valve seat by water pressure in the water flow passageway, and/or by a biasing element, e.g. a spring.

The amusement ride infrastructure may include at least one drain valve disposed to drain water from the travel surface. The drain valve includes a drain valve body defining an exit port, at least one inlet port, and an interior surface defining a water flow passageway between the at least one inlet port and the exit port and a valve seat. The exit port is exposed at the travel surface. A buoyant drain valve element is disposed within the water flow passageway for movement between a first position in sealing engagement with the valve seat and a second position spaced from the valve seat for permitting flow of water through the exit port. In some implementations, the supply valve body houses the drain valve. For example, the supply valve body defines the drain valve body.

The vehicle includes at least one drive assembly housed by the vehicle body and configured to maneuver the vehicle generally along the travel surface. In some examples, at least one compliant flap extends from the vehicle body and generally circumscribes a confined region defined between the vehicle undersurface and the travel surface. The compliant flap serves to augment creation of the cushion of water separating the vehicle undersurface from the travel surface. In some implementations, a lower portion of the vehicle body includes a reservoir and the vehicle undersurface defines at least one aperture in fluid communication with the reservoir cavity, wherein fluid from the cushion of water enters the reservoir cavity through the aperture. The drive assembly includes at least one pump disposed in the vehicle body. The pump has an inlet line in fluid communication with the reservoir cavity and an outlet line configured to discharge below the vehicle undersurface in a manner to propel the vehicle generally along the travel layer. In some instances, the pump has an inlet line in fluid communication with the reservoir cavity and an outlet line configured to discharge fluid under pressure behind the vehicle for propelling the vehicle generally along the travel surface.

In some implementations, the drive assembly includes a driven wheel disposed for engagement with the travel surface. The drive assembly rotates about an axis normal to the travel surface. The drive assembly includes a drive housing and a driven wheel supported by the drive housing operable for movement among a retracted position and a deployed position relatively more extended below the vehicle undersurface and disposed for engagement with the travel surface. The driven wheel is spring biased toward its deployed position.

The vehicle includes at least one compliant flap extending from the vehicle body and generally circumscribing the confined region defined between the vehicle undersurface and the travel surface. The compliant flap serves to augment creation of the cushion of water separating the vehicle undersurface from the travel surface. The compliant flap may comprise multiple flap elements.

The vehicle undersurface encompasses an area of at least about three valves. A valve spacing along the travel surface that provides this minimum number of valves under the vehicle insures that the valves can provide enough fluid (e.g. water) to create a fluid layer sufficient to support the vehicle and allow the vehicle to glide along the travel surface. Valve spacing along the travel surface may be modified based on a fluid flow rate through the valves to provide a fluid layer having a thickness that provides a specified minimum distance (e.g. ¼ inch) between the bottom of the vehicle and the travel surface.

The vehicle may also include a bumper disposed along at least one side region of the vehicle body. In a preferred implementation, the bumper wraps around every side of the vehicle, which may be used as a bumper car in an amusement park ride. In some examples, a water gun is mounted on the vehicle body for spraying other ride patrons or spectators. The water gun is in fluid communication with a pump disposed in the vehicle body.

The details of one or more implementations of the disclosure are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
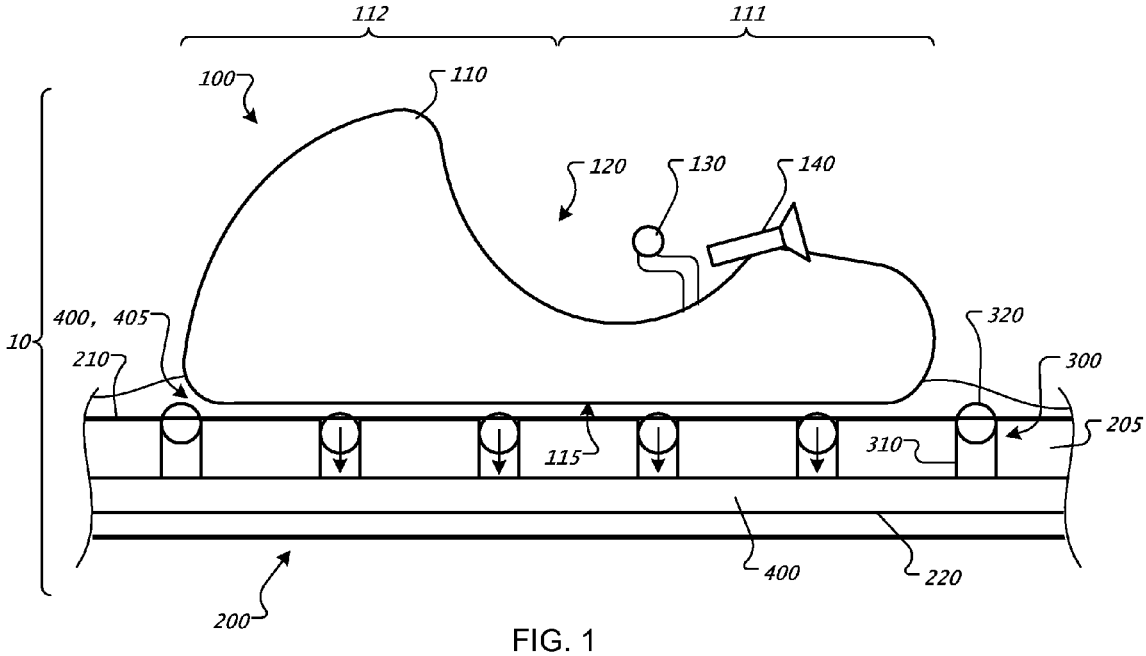
FIG. 1 is a side view of an amusement ride system.
Figure 2:
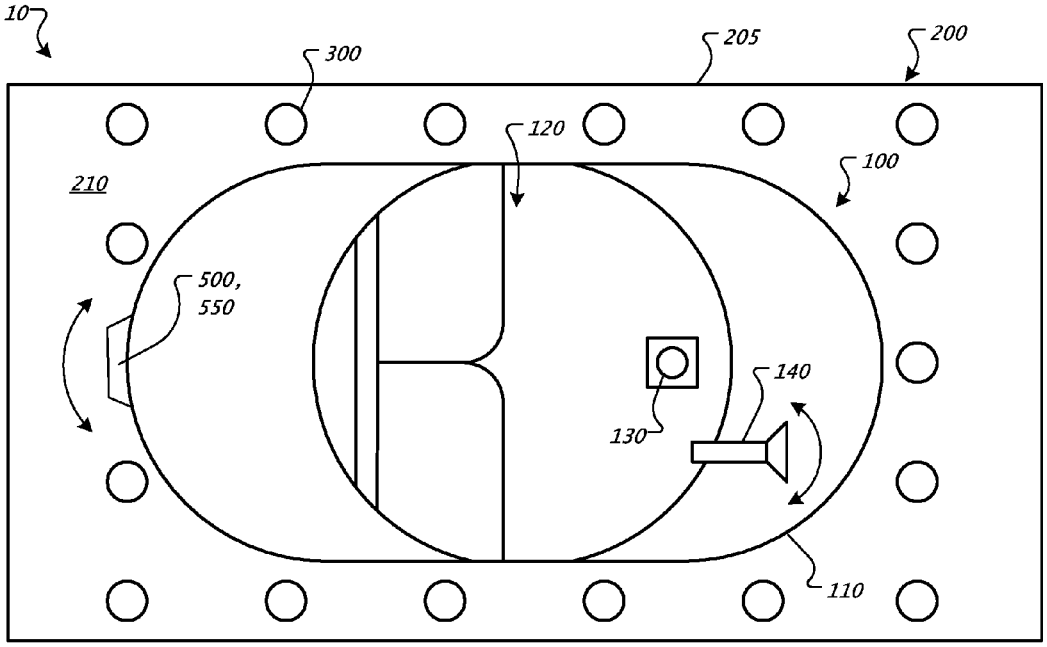
FIG. 2 is a top view of an amusement ride system.

An amusement park ride system utilizes a custom infrastructure for travel of novel vehicles about a track, each vehicle conveying one or more passengers generally along a travel surface, riding upon a cushion of water. A plurality of valves mounted to extend through the travel surface are actuated during travel of a vehicle over the valves to deliver a pressurized flow of water into a confined region defined between the vehicle undersurface and the travel surface. The pressurized flow of water into and through the confined region creates a cushion of water to separate the vehicle undersurface from the travel surface. The vehicle is thus configured to convey at least one passenger generally along the travel surface upon the cushion of water.

Turning now to the drawings, and with particular reference initially to FIGS. 1-4, an amusement ride system 10 includes an amusement ride infrastructure 200 including a support layer 205 defining a travel surface 210, and one, or preferably more, vehicles 100, each having a forward portion 111 (bow) and a rearward portion 112 (stem). The vehicle 100 has a body 110 that defines a passenger compartment 120 configured to hold one or more passengers. An undersurface 115 of the vehicle body 110 is at least partially supported by a cushioning layer 405 of fluid 400, typically water, provided at the travel surface 210 of the support layer 205. In some examples, the cushion layer 405 of fluid 400 is about ¼ inch thick. The fluid 400 may be liquid or gaseous (e.g. water or air). The vehicle 100 moves generally along the travel surface 210 by sliding, gliding and/or hydroplaning upon the fluid layer 405 on the travel surface 210. The fluid layer 405 also provides lubricity between the undersurface 115 of the vehicle body 110 and the travel surface 210 of the support layer 205. When air is used for the fluid, the vehicle 100 floats on the cushion 405 of air 400. When water is used for the fluid, the vehicle 100 buoyantly floats on the cushion 405 of water 400.

Figure 5:
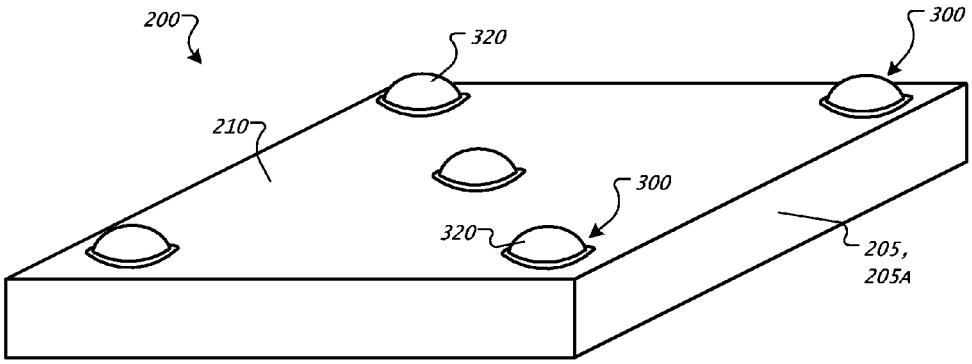
FIG. 5 is a perspective view of a travel surface of an amusement ride infrastructure.
Figure 6:
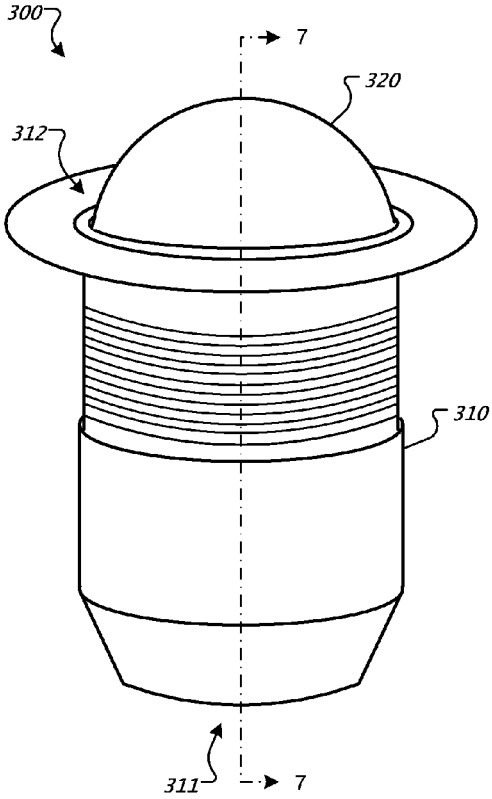
FIG. 6 is a perspective view of a supply valve.
Figure 7:
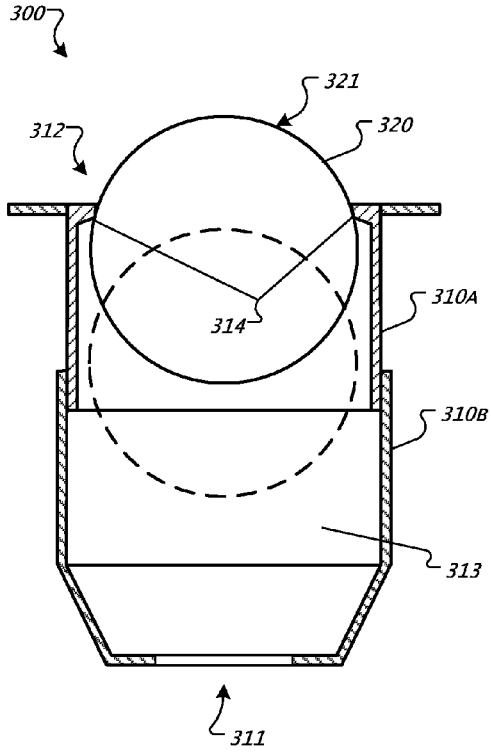
FIG. 7 is a sectional view of the valve shown in FIG. 6.

Referring to FIGS. 5-7, the infrastructure 200 includes a plurality of supply valves 300 disposed to extend through the support layer 205, to the travel surface 210. The support layer 205 may be the combination of several interconnected, interchangeable support layer sections 205A (as shown in FIG. 5). In some examples, the support layer sections 205A are 4 feet by 4 feet and include four, five, or more evenly distributed valves 300 (e.g. in an "X" pattern). Each end of the support layer section 205A is releasably attached or abutted to another end of an adjacent support layer section 205A, allowing a user to create a support layer 205 of custom size and/or custom shape. When the support layer 205 is elevated above a ground surface and supported by scaffolding or support beams, the support layer 205 may be placed on the support beams at an angle of about 45° with respect to the beams, so that the beams run diagonally under the support layer 205 between rows of valves 300. The diagonal placement of the support beams aids deflection prevention of the support layer 205.

Each valve 300 includes a valve body 310 defining at least one inlet port 311, an exit port 312, and an interior water flow passageway 313 between the inlet port(s) 311 and the exit port 312. The water flow passageway 313 defines a valve seat 314 near the exit port 312. The exit port 312 is exposed at the travel surface 210 of the support layer 205. In some examples, the valve body 310 includes upper and lower body portions 310A and 310B, respectively, disposed in fluid communication. For example, the lower body portion 310B defines female threads and the upper body portion 310A defines male threads, such that the upper body portion 310A is received by and threads into the lower body portion 310B. A valve element 320 is disposed within the water flow passageway 313 for movement among a first position in sealing engagement with the valve seat 314 and a second position spaced from the valve seat 314, permitting pressurized flow of water through the water flow passageway 313 defined by the valve body 310, and onto the travel surface 210 (into a region defined between the travel surface 210 and the undersurface 115 of a passing vehicle 100, as described more fully below). A valve element operator 321 (in one example, a portion of the valve element 320 protruding above the travel surface 210) extends through the exit port 312 and beyond the valve body 310 for actuating engagement by passing vehicles 100, again as described more fully below. The valve element 320 may be spherical, elliptical, cylindrical, cubical, pyramidal, or any other suitable shape.

The valve element 320 may be urged toward its first position in engagement with the valve seat 314 by water pressure in the water flow passageway 313. Alternatively, in the example of FIG. 8, the valve 300 includes a spring 330 biasing the valve element 320 into sealing engagement with the valve seat 314, causing the valve 300 to remain closed while not actuated. A combination of water pressure and biasing element may also be employed.

Figure 9A:
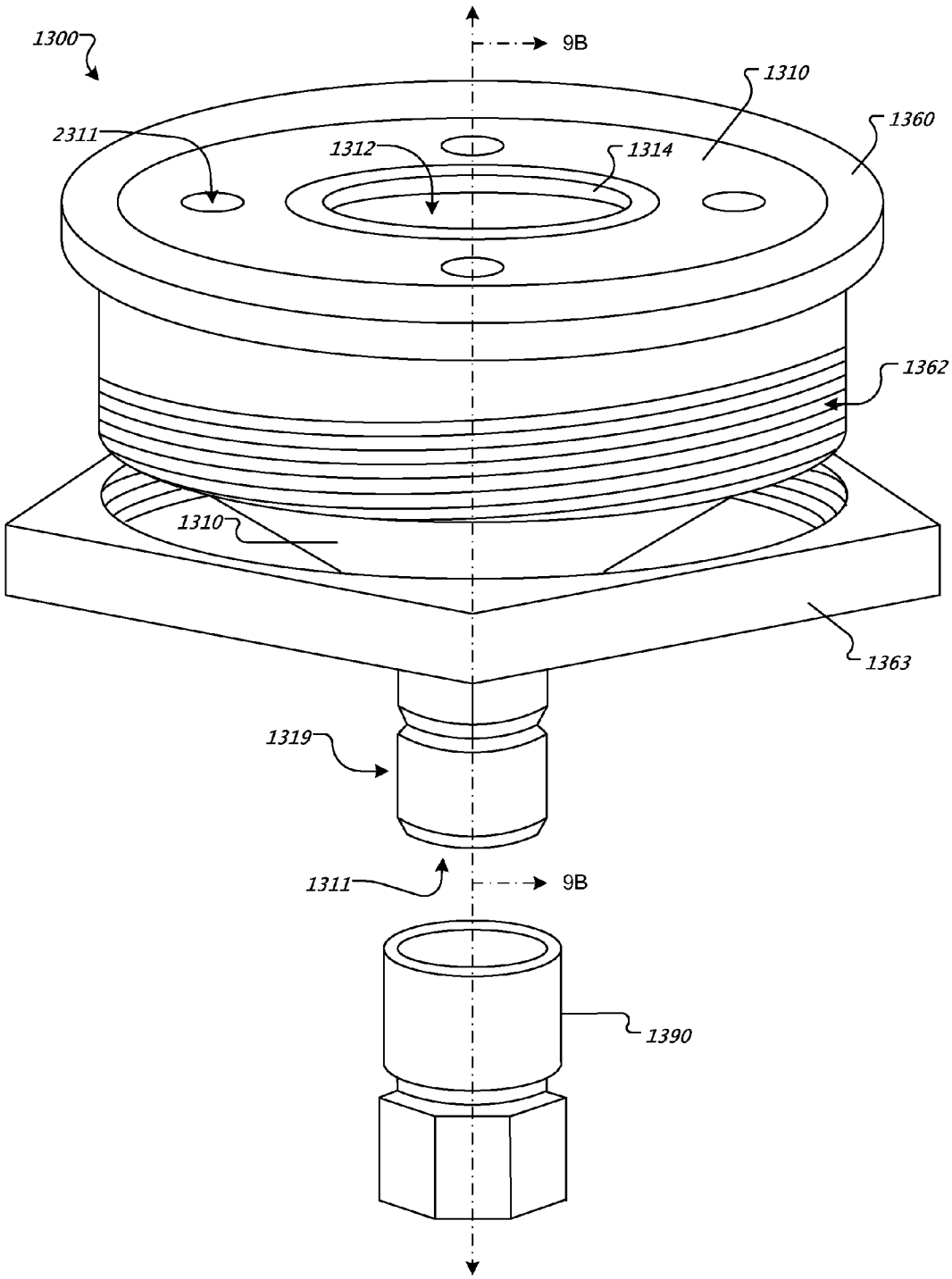
FIG. 9A is a perspective view of a supply valve having drain valves.
Figure 9B:
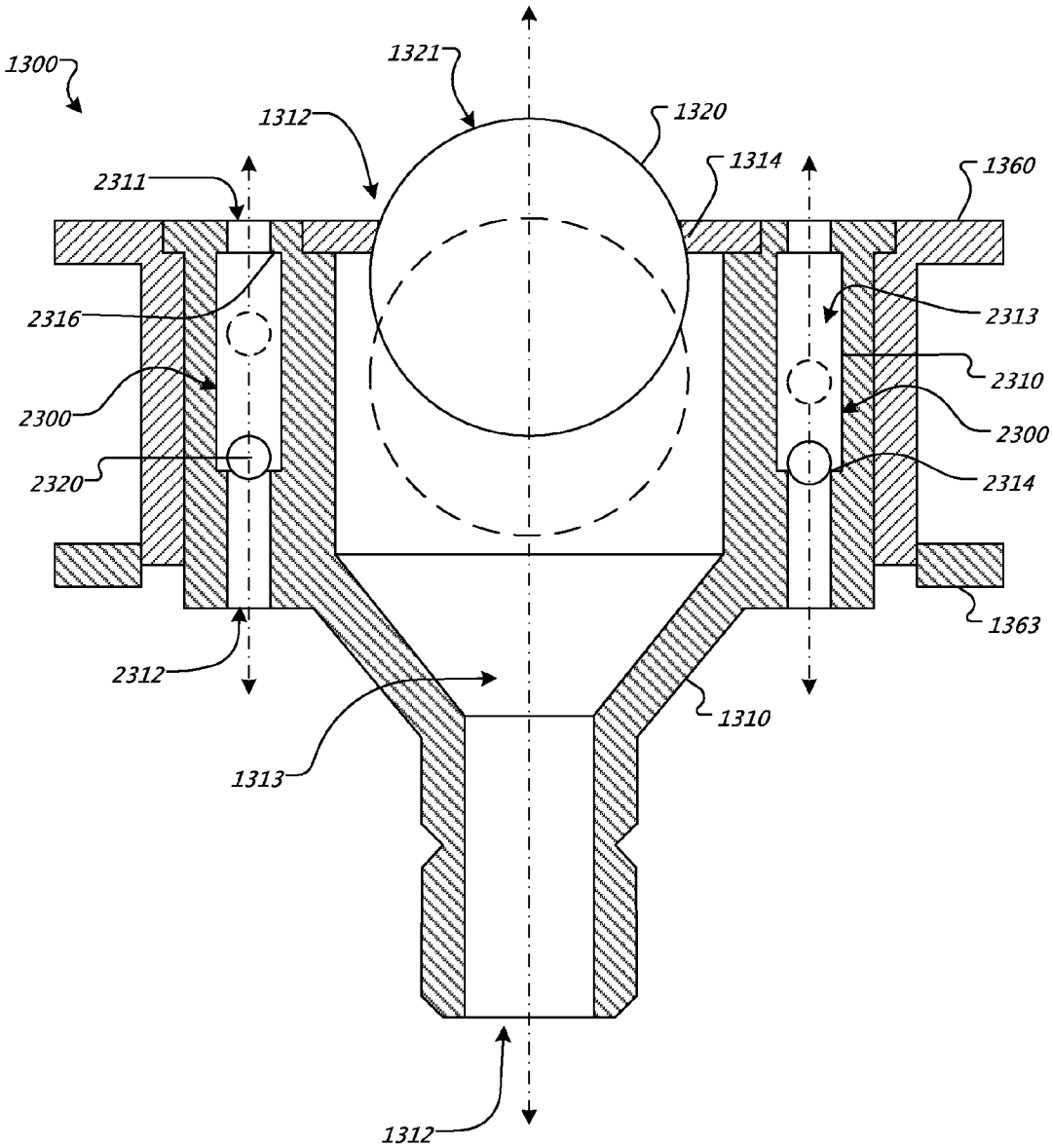
FIG. 9B is a sectional view of the valve shown in FIG. 9A.

Referring to FIGS. 9A-9B, in some implementations, the amusement ride system 10 includes supply valve 1300, which includes a valve body 1310 defining at least one inlet port 1311, an exit port 1312, and an interior water flow passageway 1313 between the inlet port(s) 1311 and the exit port 1312. The water flow passageway 1313 defines a valve seat 1314 near the exit port 1312. A valve element 1320 is disposed within the water flow passageway 1313 for movement among a first position in sealing engagement with the valve seat 1314 and a second position spaced from the valve seat 1314, permitting pressurized flow of water through the water flow passageway 1313 defined by the valve body 1310, and onto the travel surface 210. A valve element operator 1321 (in one example, a portion of the valve element 1320 protruding above the travel surface 210) extends through the exit port 1311 and beyond the valve body 1310 for actuating engagement by passing vehicles 100. The valve element 1320 may be spherical, elliptical, cylindrical, cubical, pyramidal, or any other suitable shape. In some examples, water is permitted to flow through one or more passageways defined through the valve element 1320 while the valve element 1320 is in the second position. As with supply valve 300, the valve element 1320 of supply valve 1300 may be urged toward its first position in engagement with the valve seat 1314 by water pressure in the water flow passageway 1313. Alternatively, the valve 1300 may include a spring 330 biasing the valve element 1320 into sealing engagement with the valve seat 1314, causing the valve 1300 to remain closed while not actuated. A combination of water pressure and biasing element may also be employed.

The valve 1300 may be releasably received by a valve receiver 1360, which is mounted via threads 1362 either into a threaded mounting hole defined by the support layer 205 or through a mounting hole defined by the support layer 205 and secured by a nut 1363. The valve receiver 1360 may define threads to receive the valve 1300 or slots to receive pegs protruding from the valve body 1310. In some examples, the valve 300, 1300 includes a sensor (e.g. proximity, infrared, acoustical, contact) that detects vehicles 100 passing over the valve 300, 1300 and triggers actuation of the valve element 320, 1320 to allow water 400 to pass through the valve 300, 1300.

Figure 8:
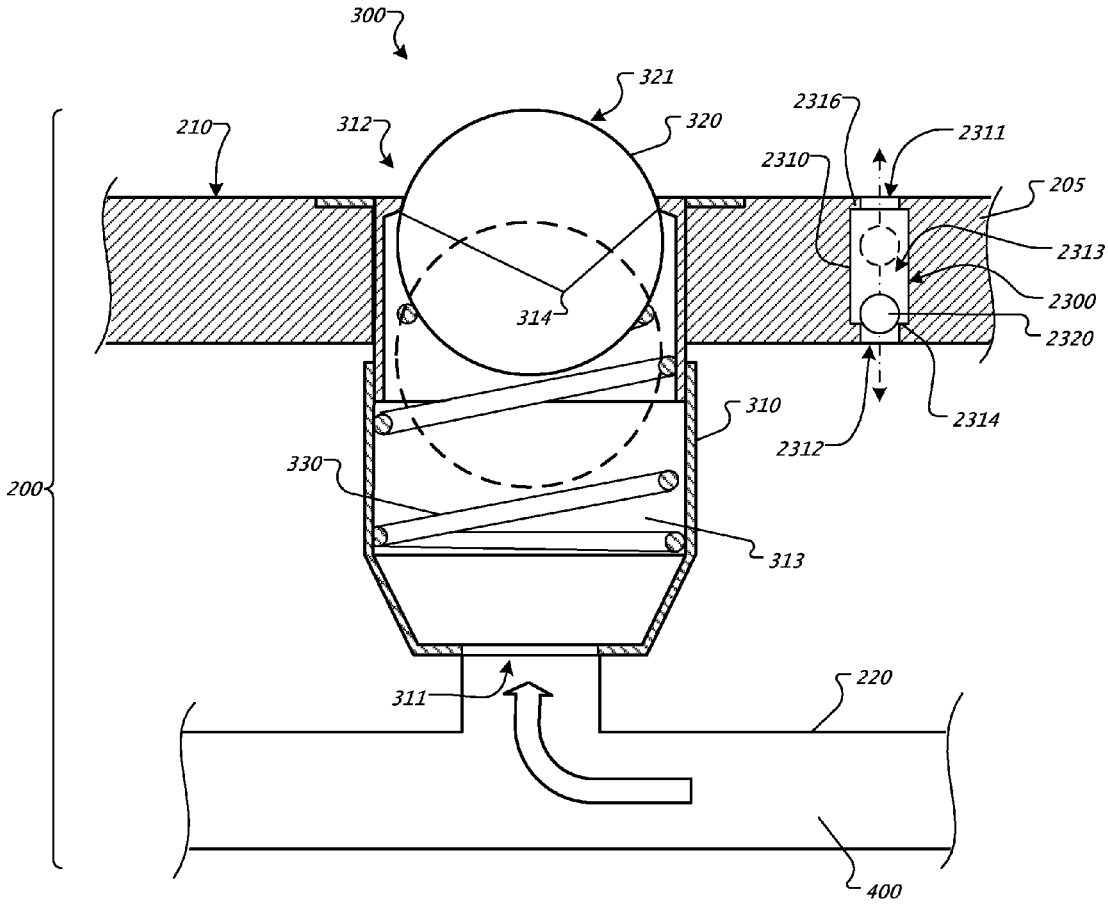
FIG. 8 is a sectional view of a travel surface of an amusement ride system.

In some implementations, the support layer 205 and/or the valve 1300 includes at least one drain valve 2300, as shown in FIGS. 8-9B. In some examples, the drain valve(s) 2300 are located adjacent the supply valves 300, 1300 and/or may be defined by the supply valve bodies 1310, as shown in FIGS. 9A-9B. The drain valve 2300 includes a drain valve body 2310 defining at least one inlet port 2311 in fluid communication with the travel surface 210, an exit port 2312, and an interior water flow passageway 2313 between the inlet port(s) 2311 and the exit port 2312. The water flow passageway 2313 defines a drain valve seat 2314 near the exit port 2312. A buoyant drain valve element 2320 is disposed within the water flow passageway 2313 for movement among a first position in sealing engagement with the drain valve seat 2314 and a second position spaced from the drain valve seat 2314, permitting a flow of water through the water flow passageway 2313 defined by the drain valve body 2310, and out the exit port 2312. The exit port 2312 may drain to the ground or be in fluid communication with a drainage system that may deliver the water to a recirculation system (e.g. storage tank and pump) for reuse. The inlet port 2311 may define a valve element retaining feature 2316 to prevent escapement of the drain valve element 2320 from the drain valve body 2310. In the example shown, the drain valve body 2310 defines the inlet port 2311 narrower than the water flow passageway 2313 retaining the drain valve element 2320. When the valve element 1320 is moved to the second position, allowing pressurized water flow out of the exit port 1312 of the valve 1300, some of the water 400 flows into the inlet port 2311 of the drain valve 2300 to escape the pressure of the vehicle 100 over head. The pressurized flow of water into the water flow passageway 2313 causes the drain valve element 2320 to move into sealing engagement with the drain valve seat 2314, closing the drain valve 2300. After the vehicle 100 passes away from the valve 1300, the water 400 becomes depressurized. The buoyant drain valve element 2320 floats up away from the drain valve seat 2314, opening the drain valve 2300 and allowing water 400 to drain off the travel surface 210.

In some implementations, the interior water flow passageway 1313 is angled with respect to the travel surface 210 to provide a directed flow of water out of the valve 1300. The directed flow of water may be used to urge vehicles 100 passing over the valve in a particular direction of travel.

Figure 10:
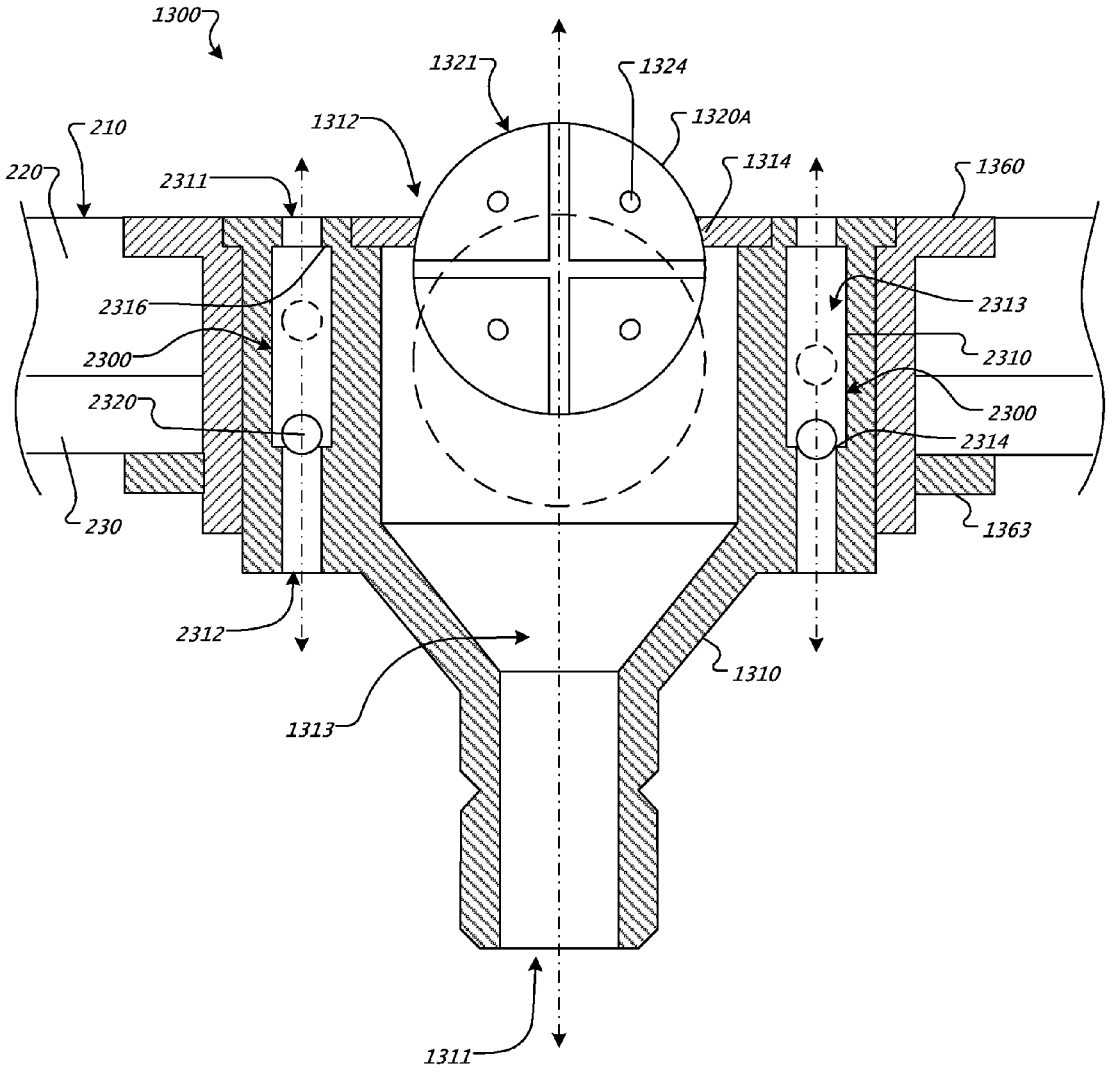
FIG. 10 is a sectional view of a supply valve.

FIG. 10 illustrates an example of the valve 1300 including a misting valve element 1320A that defines multiple water channels 1324 extending therethrough. While seated in sealing engagement against the valve seat 1314, the misting valve element 1322 allows water to pass through the second port 1312 via the water channels 1324 to spray jets of water or mist in the air for riders to drive through and/or onto the travel surface 210 to keep the travel surface 210 damp and/or cool. The valve 1300 is shown inserted through a two-part support layer 205 having a first support component layer 220 that defines the travel surface 210 supported by a second support component layer 230. The first support component layer 220 may include a composite material, honeycomb structure, laminate, or other suitable material or structure. The second support component layer 230 may include a scaffolding component or a flooring structure.

A fluid supply line 220 is in fluid communication with the valves 300, 1300 and delivers pressurized fluid 400 (water) to the valves 300, 1300. The fluid supply line 220 is generally routed below the support layer 205. The valve body 1310 may define a quick-disconnect feature 1319 configured to be received by a mating quick-disconnect fitting 1390 in fluid communication with the fluid supply line 220.

Referring again to FIGS. 3-4, the undersurface 115 of the vehicle body 110 engages the valve element operator 321 (e.g., exposed upper surface 321 (FIG. 7)) of valve element 320 of each valve 300 passing beneath the vehicle body 110, thereby opening the valves 300 as each valve is engaged, and allowing fluid 400 to flow through the valves 300 to create the cushioning fluid layer 405 beneath the vehicle body 110. As the vehicle 100 moves over the travel surface 210, the undersurface 115 of the vehicle body 110 remains in engagement with valve element operators for valves 300 beneath the vehicle body 110, and then releases the valve elements 320 of those valves 300 no longer beneath the vehicle body 110 to reestablish sealing engagement with the valve seat 314. In this manner, the cushioning fluid layer 405 is maintained substantially in the region of the vehicle undersurface, i.e. beneath the vehicle body 110. The fluid layer 405 supports the vehicle 100 and allows the vehicle 100 to move generally along the travel surface 210, by sliding, gliding and/or hydroplaning upon the travel surface 210. In some implementations, the valves 300 are arranged in the travel surface 210 so that the water cushion 405 supporting the vehicle 100 is being created and replenished by at least about three valves 300 at any given time.

When the supply valves 300, 1300 are actuated by a passing vehicle 100, pressurized water is permitted to flow through the water flow passageway 313 defined by the valve body 310 and onto the travel surface 210 into a region defined between the travel surface 210 and the undersurface 115 of a passing vehicle 100. As the vehicle 100 buoyantly floats on the cushion 405 of water 400, the hydrostatic pressure of the vehicle 100 on the cushion 405 of water 400 causes the valve element 2320 of the drain valve 2300 to move to the first position in sealing engagement with the valve seat 2314, thereby preventing drainage of the water 400 through the drain valve 2300. After the vehicle 100 passes over and away from the drain valve 2300, the hydrostatic pressure in the cushion 405 of water 400 dissipates and the valve element 2320 floats up to the second position away from the valve seat 2314, allowing the water 400 to flow through the water flow passageway 2313 and drain off the travel surface 210.

Figure 11:
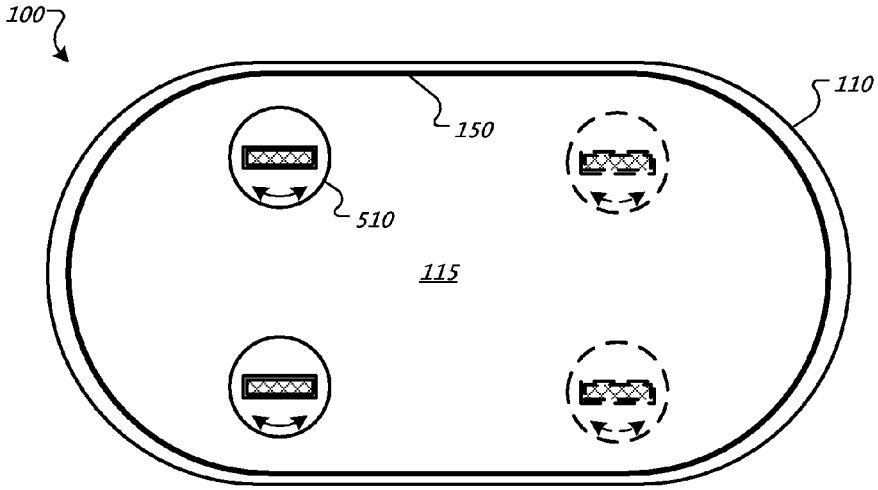
FIGS. 11-12 are bottom views of vehicles having one or more compliant flaps along a perimeter of a vehicle undersurface and a drive assembly.
Figure 12:
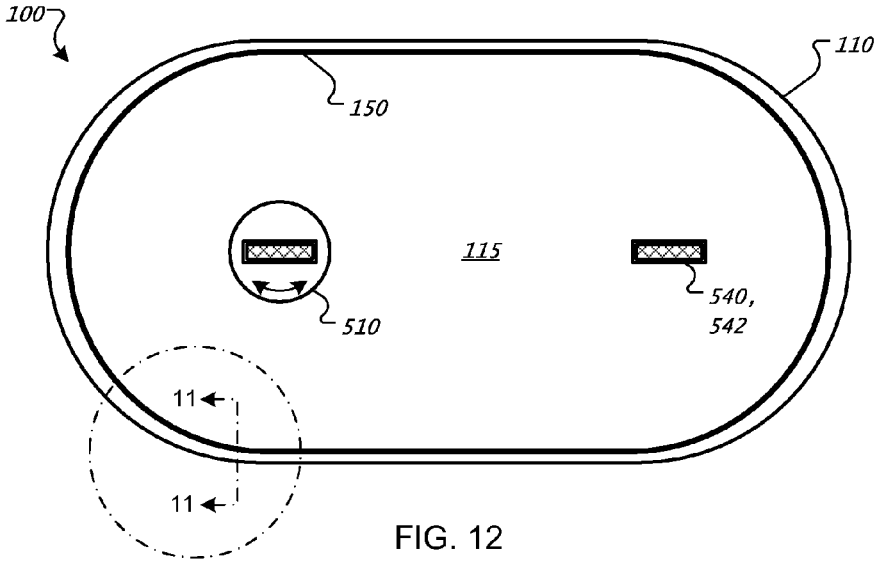
Figure 13:
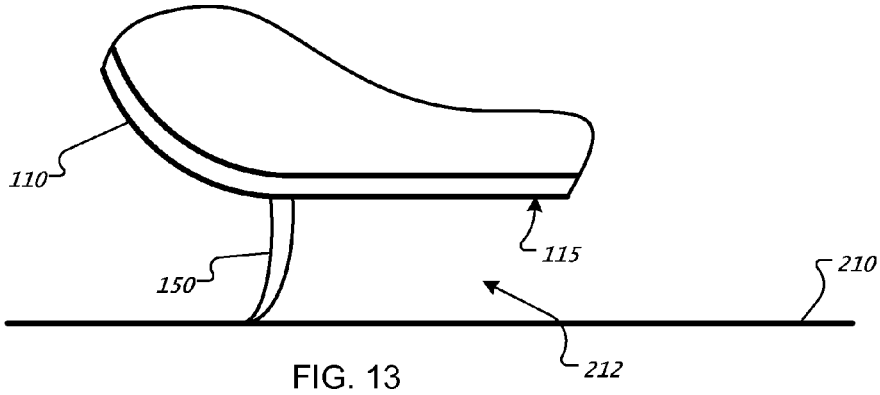
FIG. 13 is a partial sectional view of a vehicle undersurface shown in FIG. 12.
Figure 14:
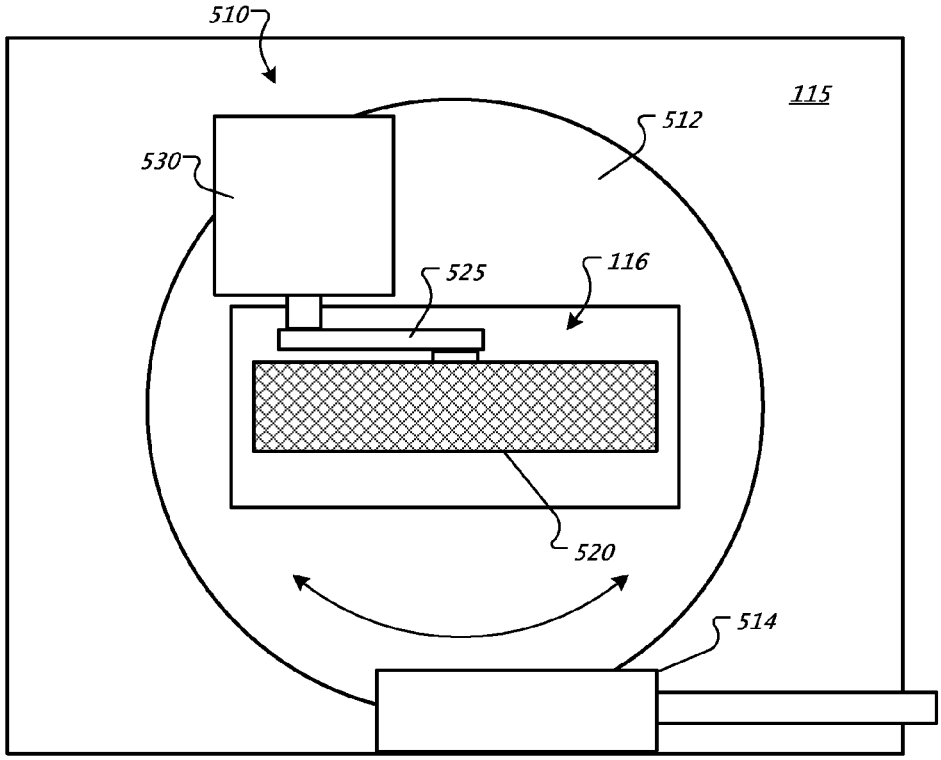
FIG. 14 is a top view of a drive assembly for a vehicle having a drive wheel that swivels and moves vertically.

In the examples illustrated in FIGS. 11-13, the water cushion is confined to the region generally between the vehicle undersurface 115 and the travel surface 210 by a compliant flap 150 (e.g. rubber squeegee) extending generally downwardly from the vehicle body 110 and circumscribing about or along the perimeter of the vehicle undersurface 115. The compliant flap 150 resists fluid flow from beneath the vehicle body 110, and in cooperation with the vehicle undersurface 115 of the vehicle body 110 and the travel surface 210 of the support layer 205, defines the confined region or gap 212 between the undersurface 115 of the vehicle body 110 and the travel surface 210 of the support layer 205 containing the cushion 405 of fluid 400. The compliant flap 150 serves to augment creation of the cushion 405 of fluid 400 (e.g. water) separating the vehicle undersurface 115 from the travel surface 210.

Figure 3:
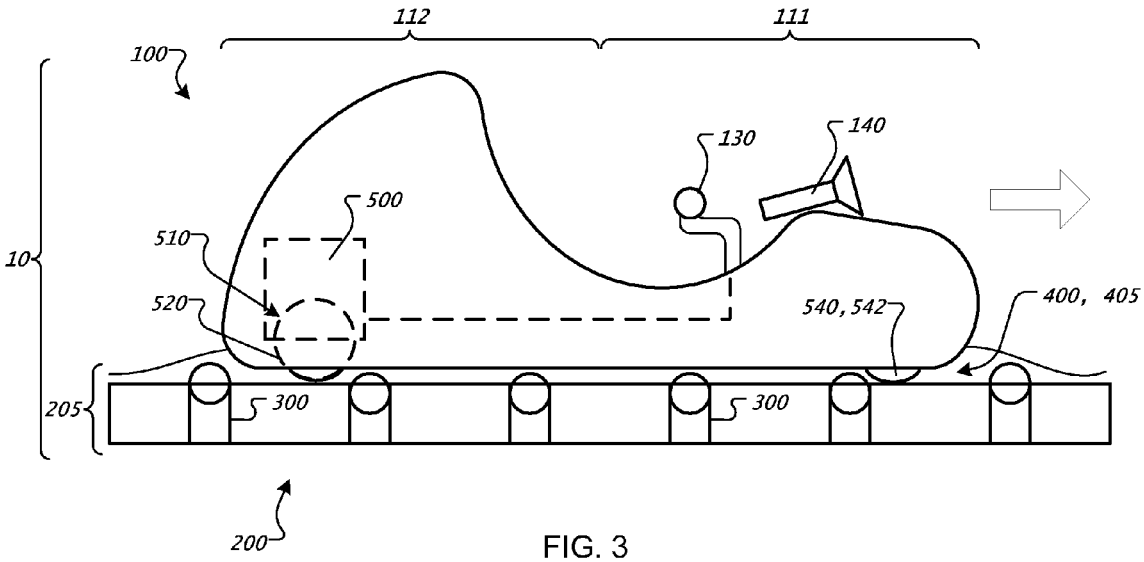
FIGS. 3-4 are side views of an amusement ride system having vehicles with a drive assembly.
Figure 4:
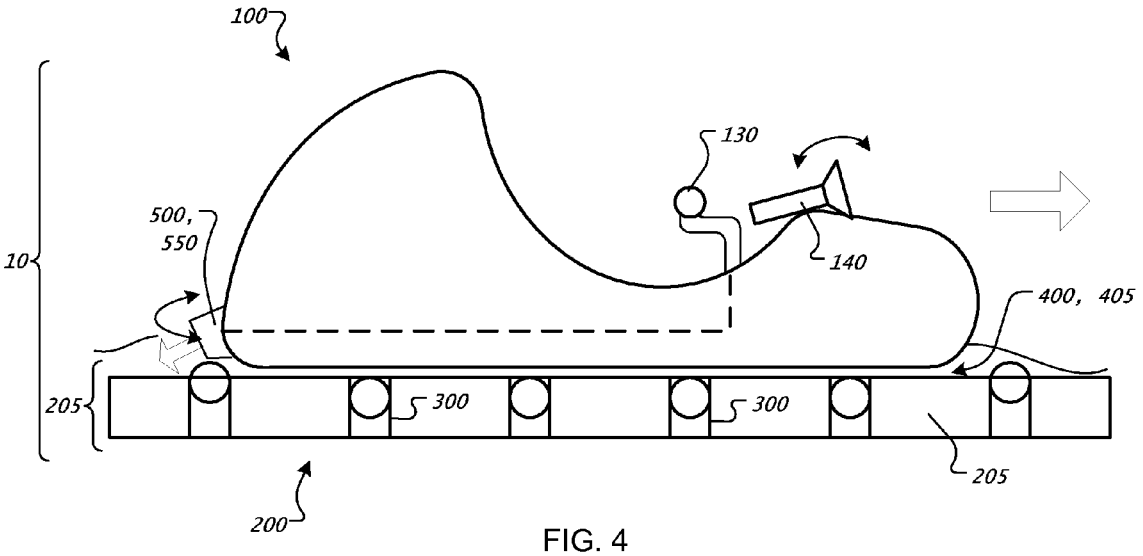

Referring back to the examples illustrated in FIGS. 1-4, a steering device 130, disposed in the passenger compartment 120, is operably coupled to or in communication with a drive system 500 that propels and/or directs the vehicle 100 over the travel surface 210. In the example shown, the steering device 130 is a joystick-type device, where a user pushes the stick 130 in a direction of desired travel to maneuver the vehicle 100 in that direction. The drive system 500 may include a driven wheel 520 disposed in engagement with the travel surface 210, e.g. as shown in FIG. 3, or a fluid jet 550 having a fluid discharge direction controllable by the steering device 130, as shown in FIG. 4.

In some implementations, the drive system 500 includes one or more drive assemblies 510 housed by the vehicle body 110, e.g. as shown in FIGS. 11-12, and configured to maneuver the vehicle 100 over the travel surface 210. The drive assembly 510 includes a drive wheel 520 operably coupled to a motor 530 and in contact with the travel surface 210 of the support layer 205 to move the vehicle 100 in a desired direction. The drive assembly 510 may be secured to a circular swivel plate 512 that freely rotates in a corresponding mounting plate opening 116 defined in the undersurface 115 of the vehicle body 110, and may be used to allow the drive wheel 520 to caster over the travel surface 210. In some implementations, a swivel actuator 514 (e.g. a motor, linkage, or rack and pinion system) is coupled to the swivel plate 512 to control rotation of the swivel plate 512, thereby controlling a drive direction.

In the examples illustrated in FIGS. 3 and 12, the vehicle 100 includes a drive wheel 520 and a tag wheel 540. The wheel drive wheel 520 and the tag wheel 540 are disposed on opposite portions 111, 112 of the vehicle 100, so that the driven vehicle 100 does not spin uncontrollably in place. The tag wheel 540 may be implemented as a steering wheel 542 that is controlled by the steering device 130.

Figure 17:
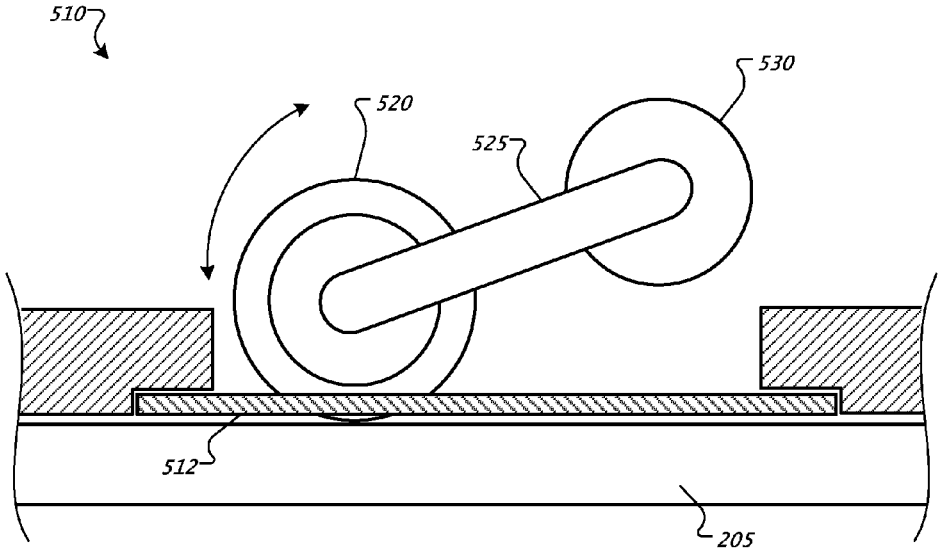

In the example illustrated in FIGS. 14-17, the swivel plate 512 is constrained in the mounting plate opening 116 from moving upwardly in the vertical direction. The motor 530 is mounted to the swivel plate 512 and drives the drive wheel 520, which is coupled to a linkage 525 that allows the drive wheel 520 to pivot upwardly into the vehicle body 110, as, for example, when the supply of fluid 400 to the travel surface 210 ceases and the vehicle 100 rests on the travel surface 210 of the support layer 205, as shown in FIG. 17. Referring once again to FIGS. 5-7, when the supply of fluid 400 to the travel surface 210 is resumed, the undersurface 115 of the vehicle body 110 engages the valve element operators 321 of valve elements 320 for valves 300 beneath the vehicle body 110, displacing the valves element 320 from sealing engagement with the associated valve seats 314, allowing water 400 to flow through the opened valves 300, creating the cushioning fluid layer 405 which elevates the vehicle body 110 upon the travel surface 210. As the vehicle body 110 elevates, the linkage 525 pivots with the drive wheel 520 downwardly to maintain contact between the drive wheel 520 and the travel surface 210 of the support layer 205. In the example shown in FIG. 16, a spring 526 biases the linkage 525 and associated drive wheel 520 downwardly to maintain contact with the travel surface 210 of the support layer 205.

Figure 18:
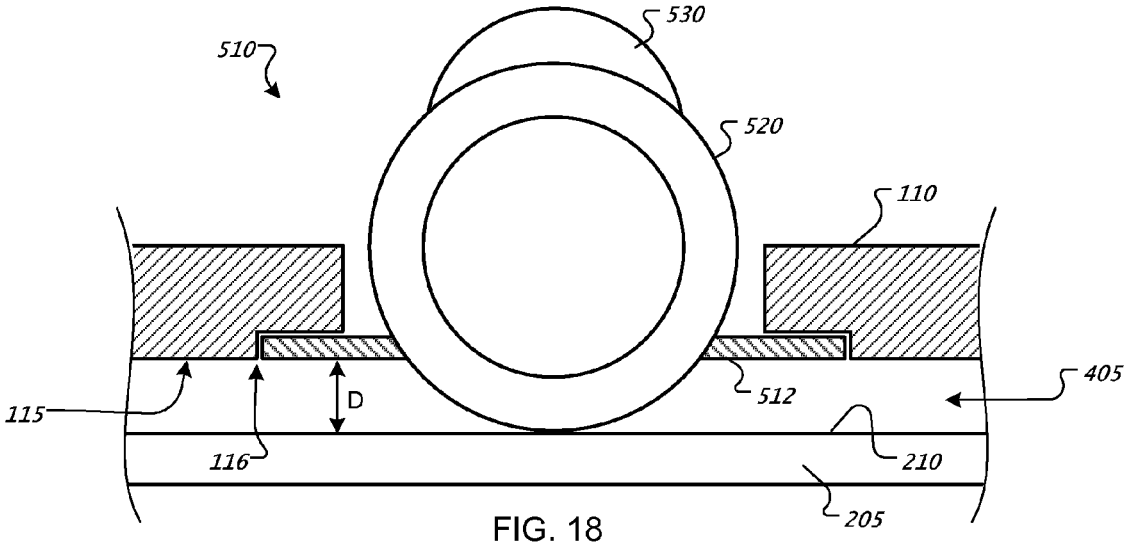
FIG. 18 is a side view of a drive assembly for a vehicle having a drive wheel that swivels.

In the example illustrated in FIG. 18, the swivel plate 512 is constrained in the mounting plate opening 116 from moving upwardly in the vertical direction and the drive wheel 520, which is coupled to the motor 530, does not pivot upwardly into the vehicle body 110. Instead, this configuration maintains a minimum distance, D, between the undersurface 115 of the vehicle body 110 and the travel surface 210 of the support layer 205. Consequently, in the absence of the fluid layer 405, the vehicle 100 can still be moved via the wheel(s) 520 over the travel surface 210.

Figure 15:
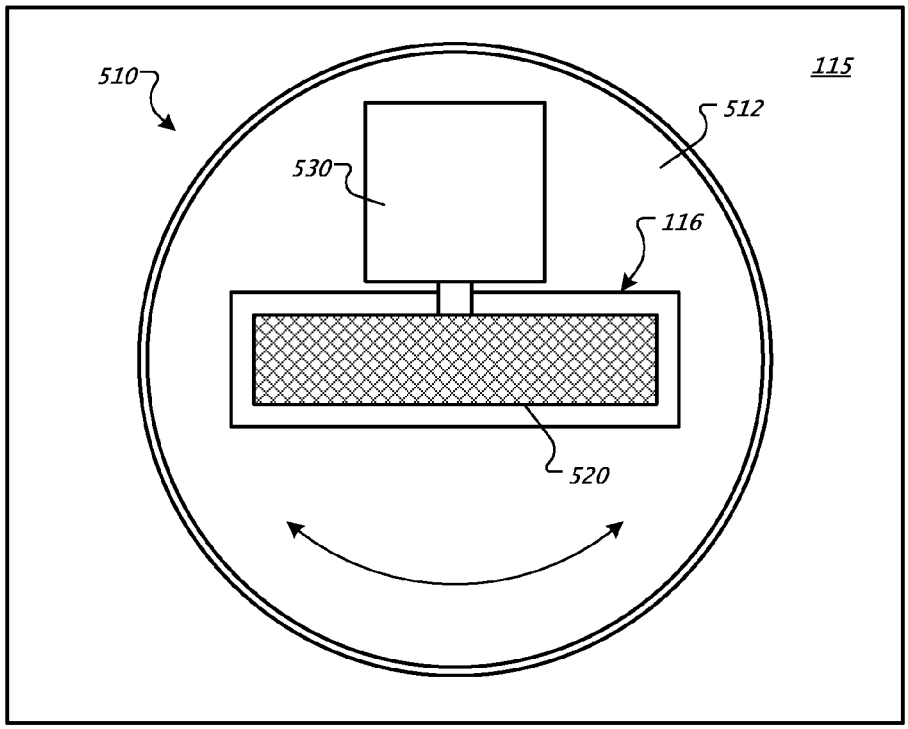
FIG. 15 is a top view of a drive assembly for a vehicle having a drive wheel that swivels.
Figure 16:
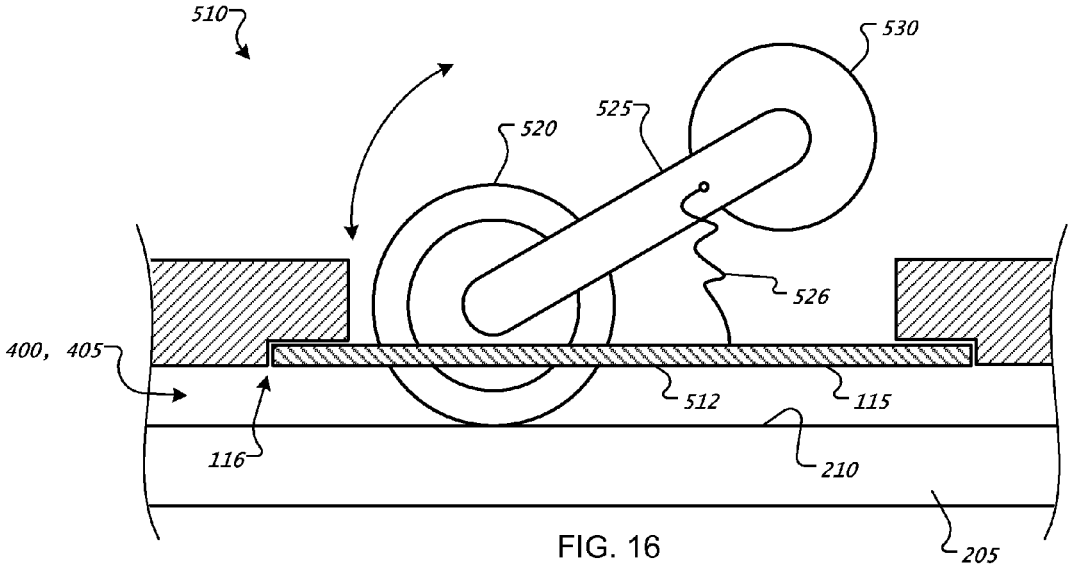
FIGS. 16-17 are side views of a drive assembly for a vehicle having a drive wheel that swivels and moves vertically.
Figure 19:
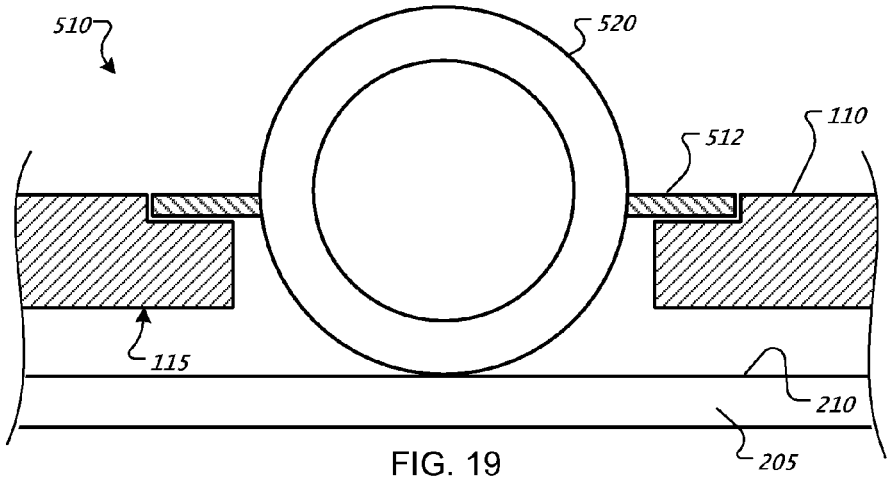
FIGS. 19-20 are side views of a drive assembly for a vehicle having a drive wheel that swivels and moves vertically.
Figure 20:
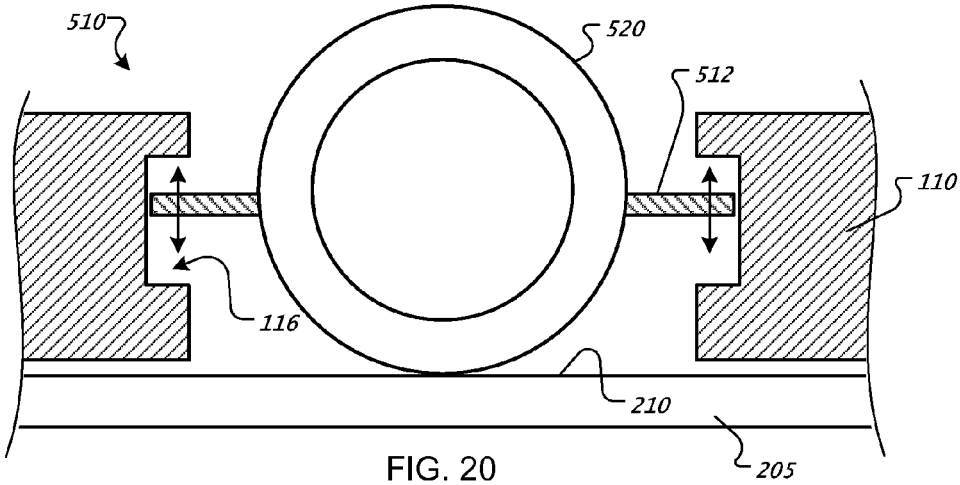

In the example illustrated in FIGS. 15, 19, and 20, the swivel plate 512 and associated drive assembly 510 are free to move upwardly in the vertical direction. In some examples, the swivel plate 512 exits the mounting plate opening 116, as shown, while in other examples, the mounting plate opening 116 is defined sufficiently deep to accommodate the elevation change between the swivel plate 512 and the vehicle body 110. As in the previous example, the motor 530 is secured to the swivel plate 512 and is also coupled to the drive wheel 520. When the supply of fluid 400 to the support surface 205 ceases, the drive assembly 510 maintains its position with the drive wheel 520 in contact with the travel surface 210 as the vehicle body 110 descends onto and rests on the travel surface 210 of the support layer 205. When the supply of fluid 400 to the travel surface 205 is resumed, the undersurface 115 of the vehicle body 110 engages the valve element operators of valve elements 320 for valves 300 beneath the vehicle body 110, displacing the valves element 320 from sealing engagement with the associated valve seats 314, allowing water 400 to flow through the opened valves 300, creating the cushioning fluid layer 405 which elevates the vehicle body 110 upon the travel surface 210. As the vehicle body 110 elevates, the drive assembly 510 maintains its position with the drive wheel 520 in contact with the support surface 205.

Figure 21:
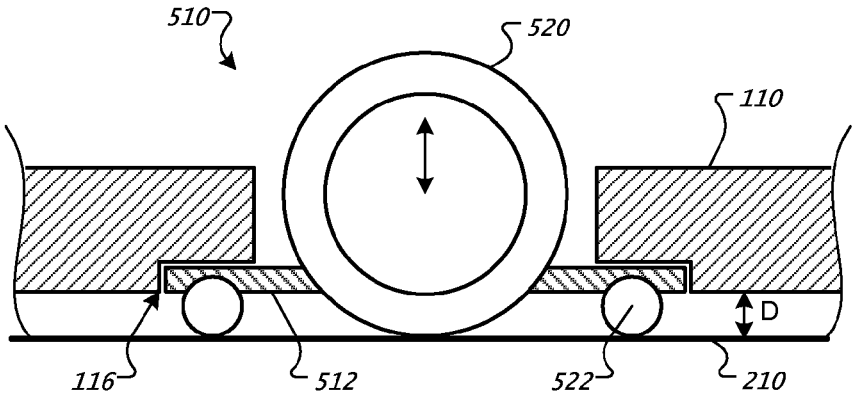
FIG. 21 is a side view of a drive assembly for a vehicle having a drive wheel that swivels and moves vertically.
Figure 22:
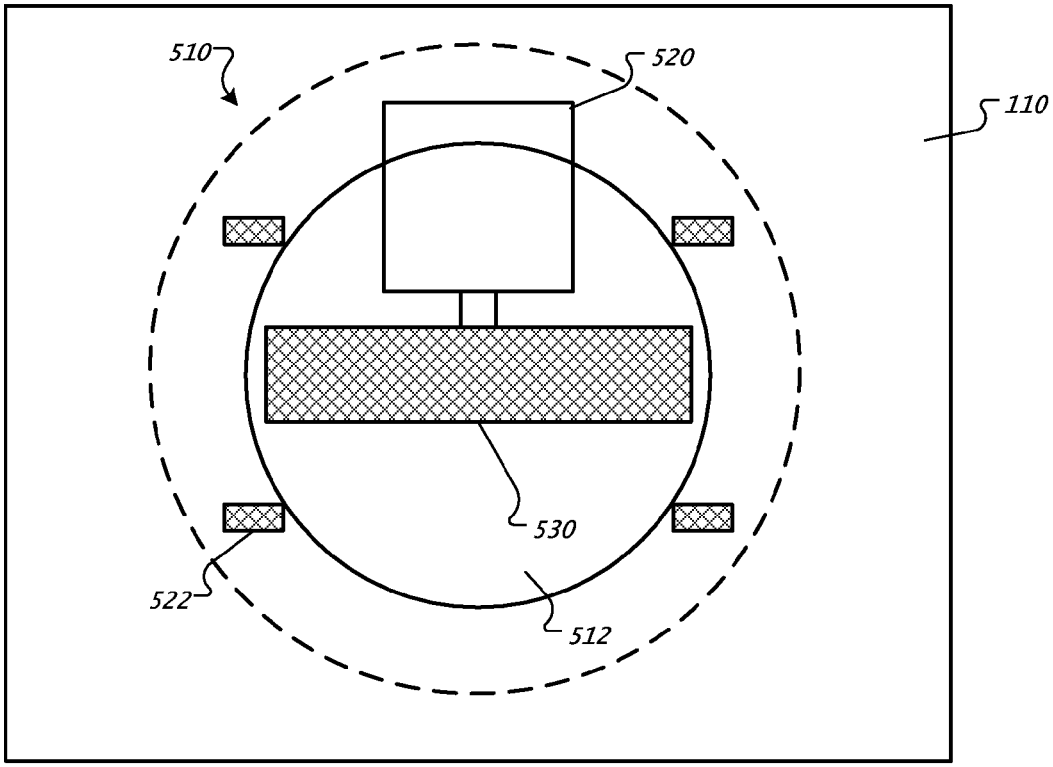
FIG. 22 is a top view of the drive assembly shown in FIG. 21.

In the example illustrated in FIGS. 21-22, the swivel plate 512 is constrained in the mounting plate opening 116 from moving upwardly in the vertical direction. The motor 530 is coupled to the drive wheel 520 and move together vertically in relation to the swivel plate 512 (e.g. via a linkage, bracket, guide, etc.). One or more support wheels 522 (four are shown) are mounted to the swivel plate 512 to maintain a minimum distance, D, between the undersurface 115 of the vehicle body 110 and the travel surface 210 of the support layer 205. The support wheels 522 may include caster wheels or roller balls in sockets that allow movement in any direction. Consequently, in the absence of the fluid layer 405, the vehicle 100 can be moved along the travel surface 210. The minimum distance D is set so that the undersurface 115 of the vehicle body 110 engages the valve element operators 321 of valves 300 beneath the vehicle body 110. When fluid 400 is supplied to the travel surface 210, it flows through the open valves 300 to create the cushioning fluid layer 405 which elevates the vehicle body 110 above the travel surface 210. As the vehicle body 110 elevates, the drive assembly 510 maintains its position with the drive wheel 520 in contact with the travel surface 210.

Figure 23:
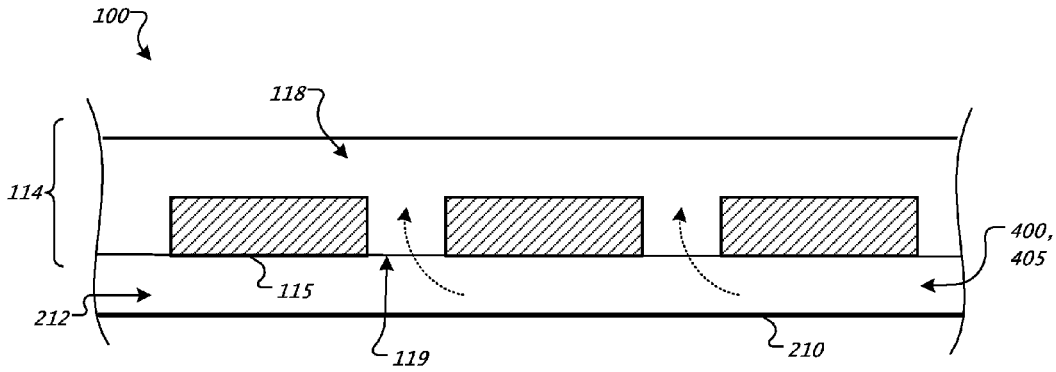
FIG. 23 is a side view of a lower portion of a vehicle defining a reservoir cavity.
Figure 24A:
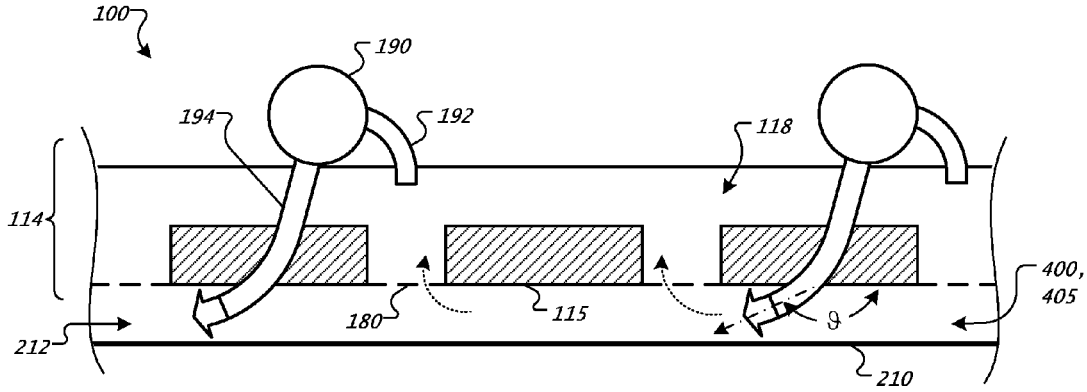
FIG. 24 is a side view of a lower portion of a vehicle defining a reservoir cavity and having a pump discharging below the vehicle.
Figure 24B:
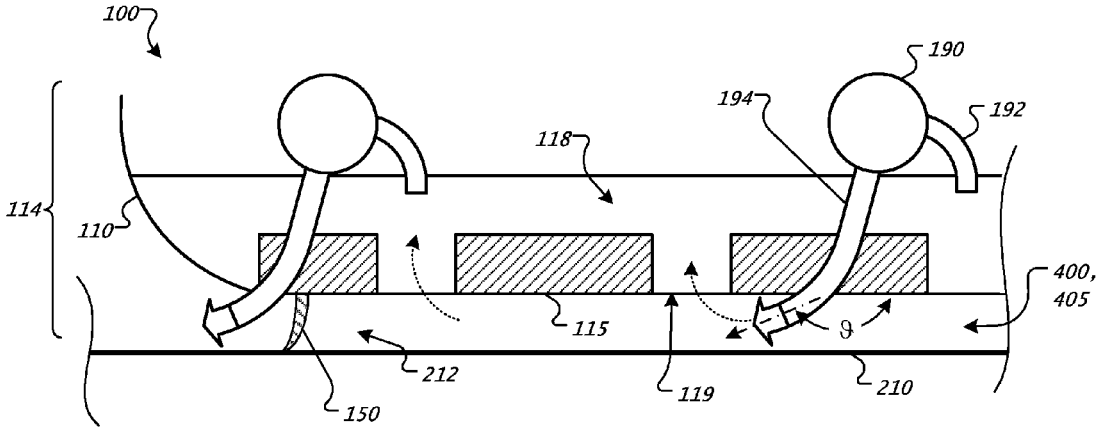

In the examples illustrated in FIGS. 23-24B, a lower portion 114 of the vehicle 100 defines a reservoir cavity 118 for receiving and temporarily holding fluid 400. The undersurface 115 of the vehicle 100 defines one or more apertures 119 in fluid communication with the reservoir cavity 118. As fluid 400 flow from the open valves 300 underneath the vehicle 100, the weight of the vehicle 100 creates hydrostatic pressure on the fluid 400 causing the fluid 400 to follow along paths of least resistance out from beneath the vehicle 100, with one being through the apertures 119 and into the reservoir cavity 118. Examples including the compliant flap 150 circumscribing the vehicle body 110 to define the region 212 between the undersurface 115 of the vehicle body 110 and the travel surface 210 of the support layer 205 experiencing relatively larger hydrostatic pressure on the fluid 400 in the region 212, thereby resulting in relatively greater fluid flow into the reservoir cavity 118. In some examples, e.g. as shown in FIG. 24A, a screen 180 (e.g. wire mesh, plate defining an array of holes, or a grill) is secured over the aperture 119 to prevent debris from entering the reservoir cavity 118.

In some implementations, at least one pump 190 having an intake line 192 and an outlet line 194 is disposed in the vehicle 100. The intake line 192 is in fluid communication with the reservoir cavity 118 and the outlet line 194 discharges fluid 400 into the region 212 beneath the vehicle 100, as shown in FIG. 24A, and/or behind the vehicle 100, as shown in FIG. 24B. The outlet line 194 discharges fluid 400 at an angle θ with respect to the undersurface 115 of the vehicle body 110, to propel the vehicle 100 forward generally along the travel surface 210. The pump 190 may function as part of the drive system 500 and/or fluid jet 550 described earlier in regards to FIG. 4. The steering device 130 may control the discharge direction and/or angle θ of the pump outlet line 194/fluid jet 550 to maneuver the vehicle 100 along the travel surface 210. In some examples, the travel surface 210 of the support layer 205 has a knurled, dimpled, or other surface finish that provides fictional resistance against the discharged fluid 400 to aid propulsion efficiency.

Figure 25:
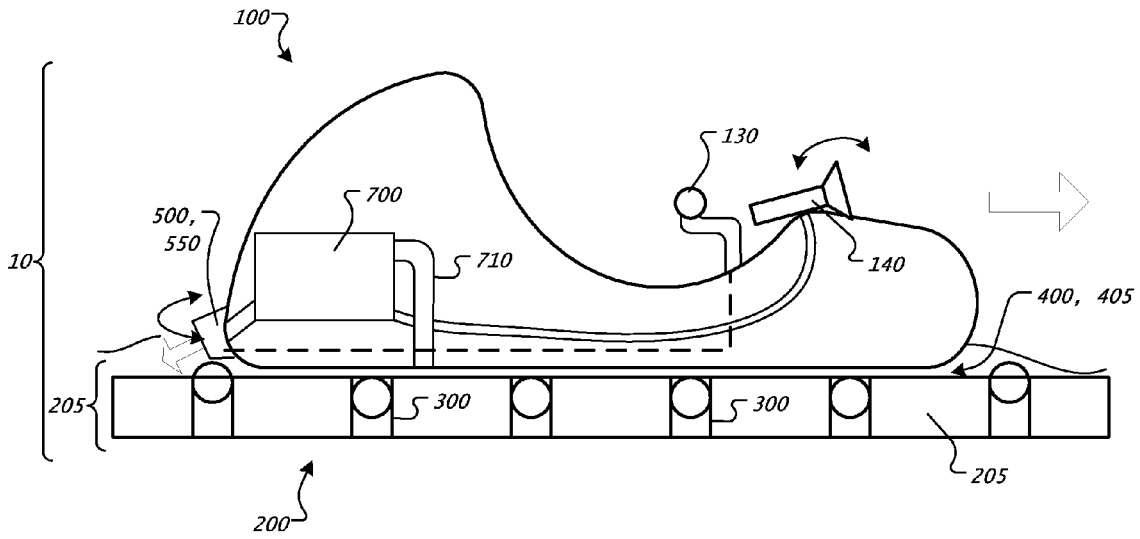
FIG. 25 is a side view of a lower portion of a vehicle defining a reservoir cavity and having a pump discharging behind the vehicle.

In the example illustrated in FIG. 25, the vehicle body 110 houses a reservoir 700 for receiving and temporarily holding fluid 400. One or more reservoir feed lines 710 extend from the reservoir 700 to the undersurface 115 of the vehicle body 110 to receive pressurized water 400, 405 trying to escape from under the vehicle 100. The received water 400 flows into the reservoir 700 for delivery to a water propulsion system 550 and/or a water gun 140.

In some examples, the vehicle 100 includes a water gun 140, as shown in FIGS. 1-4, mounted on the forward portion or bow 111 of the vehicle 100. The water gun 140 may be in fluid communication with the reservoir cavity 118 and/or the outlet line 194 of the pump 190 discharging fluid 400. The water gun 140 is rotatable (e.g. via a ball and socket joint) in one or more directions to provide a sweeping range of movement for a user to shoot fluid 400 (e.g. water) throughout a defined range of motion. In some cases, the water gun 140 is tethered to the vehicle 100, as by a water supply line.

Figure 26:
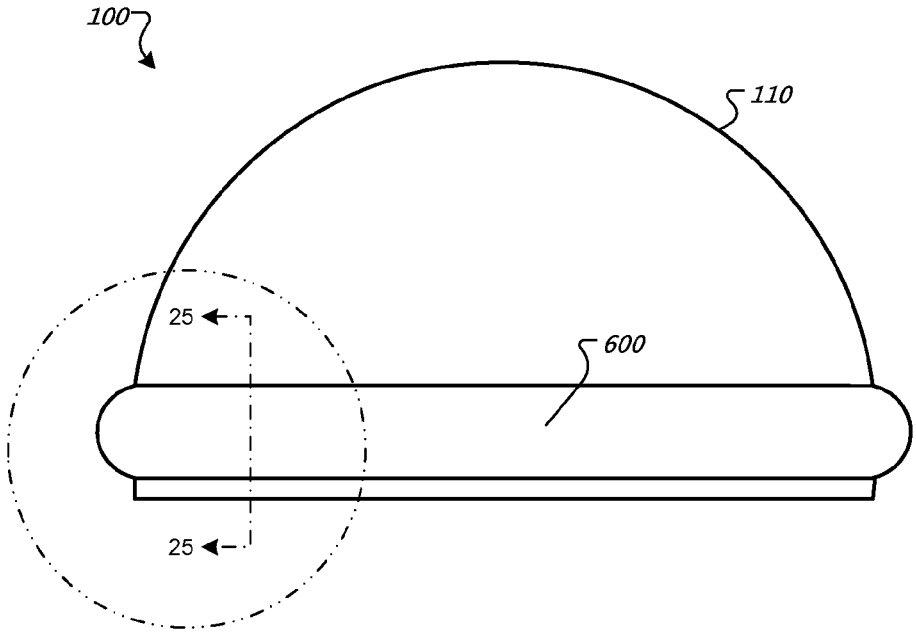
FIG. 26 is a back view of a vehicle with a bumper.
Figure 27:
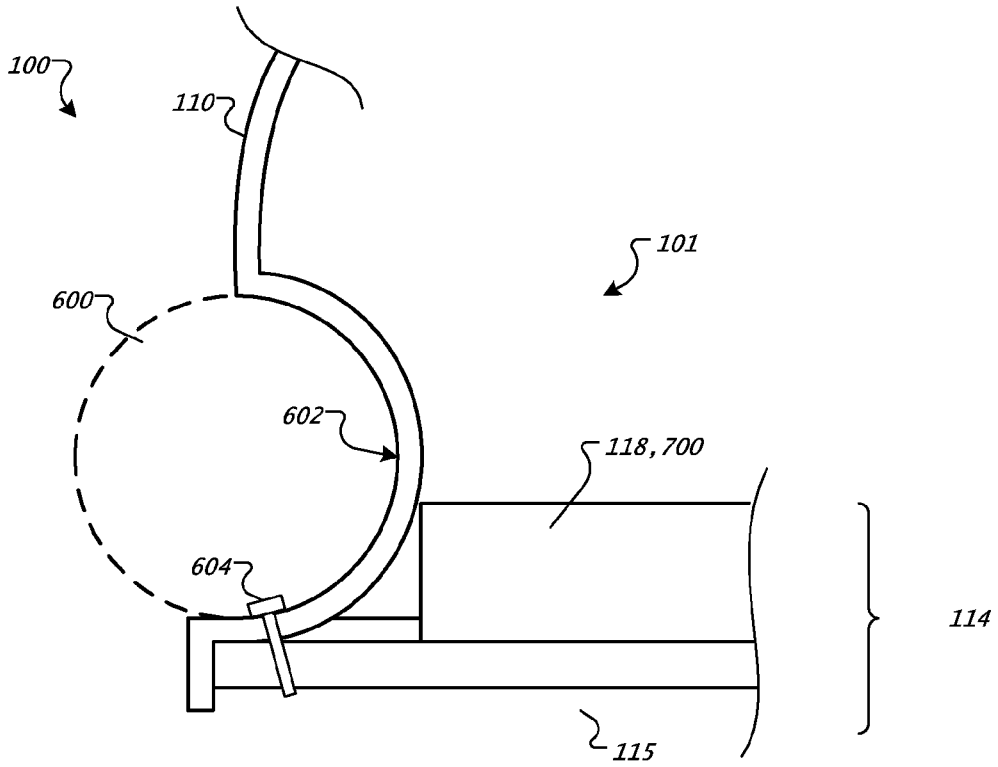
FIG. 27 is a partial sectional view of the vehicle shown in FIG. 26.

In the examples illustrated in FIGS. 26-27, the vehicle 100 includes a bumper 600 (e.g. solid rubber or inflatable tube) secured to the vehicle body 110. The vehicle body 110 may define a bumper recess 602 configured to receive the bumper 600. In some implementations, the vehicle body 110 is separate from and removably secured (e.g. via a fastener 604, such as bolt or eccentric clamp) to the lower portion 114 of the vehicle 100. This provides access to an inside portion 101 of the vehicle 100 (e.g. for maintenance) and allows different vehicle bodies 110 to be interchanged on the lower portion 114 of the vehicle 100 (e.g. for maintenance, appearance, etc). The different vehicle bodies 110 may have different, shapes, colors, themes, or other aesthetic characteristics.

Figure 28:
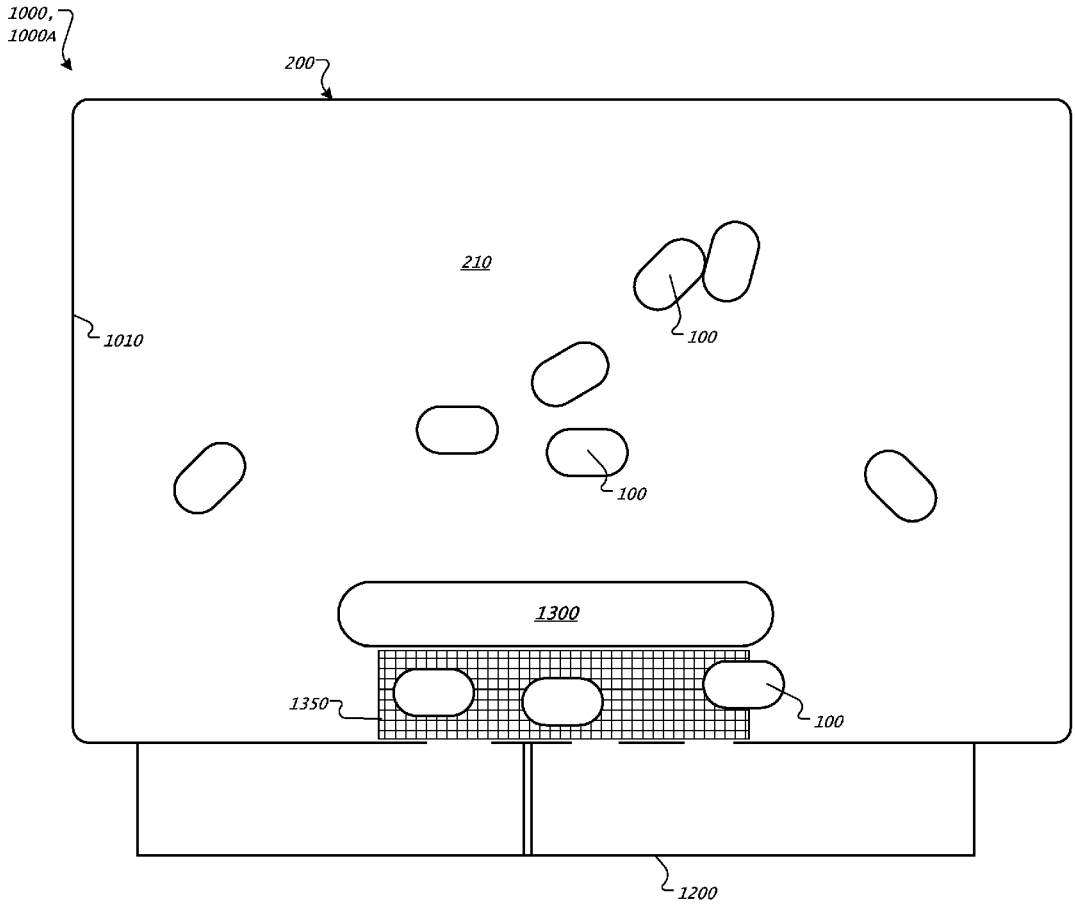
FIG. 28 is a top view of an amusement ride system with an infrastructure having a travel surface defining a rectangular track.
Figure 29:
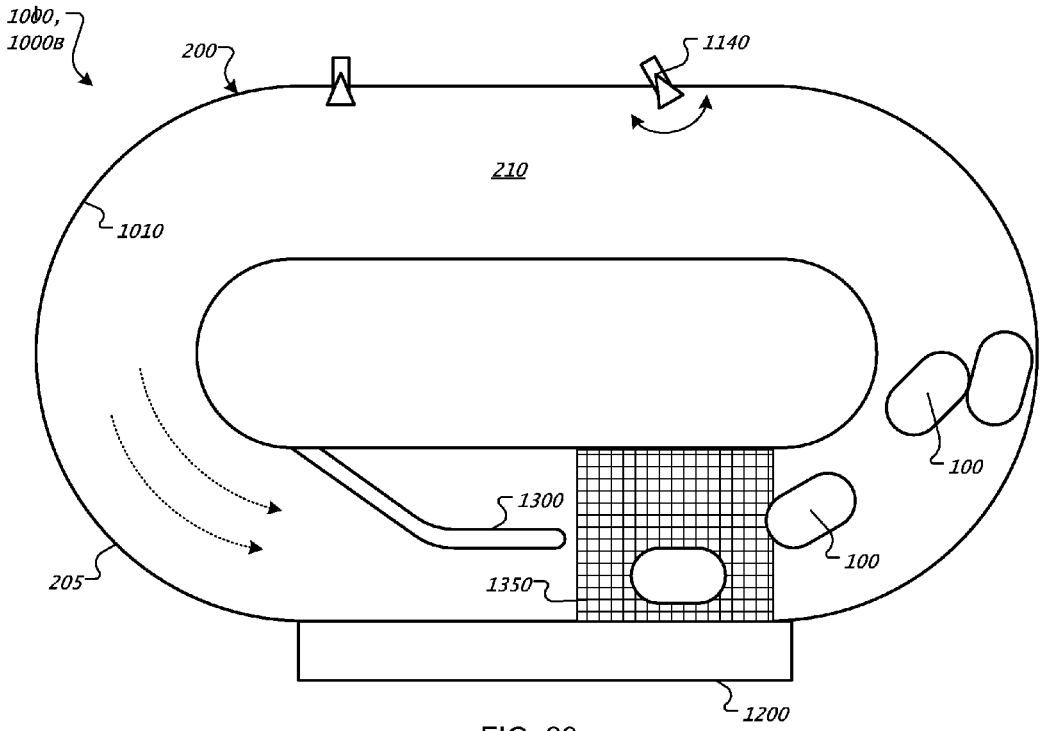
FIG. 29 is a top view of an amusement ride system with an infrastructure having a travel surface defining an oval track.
Figure 30:
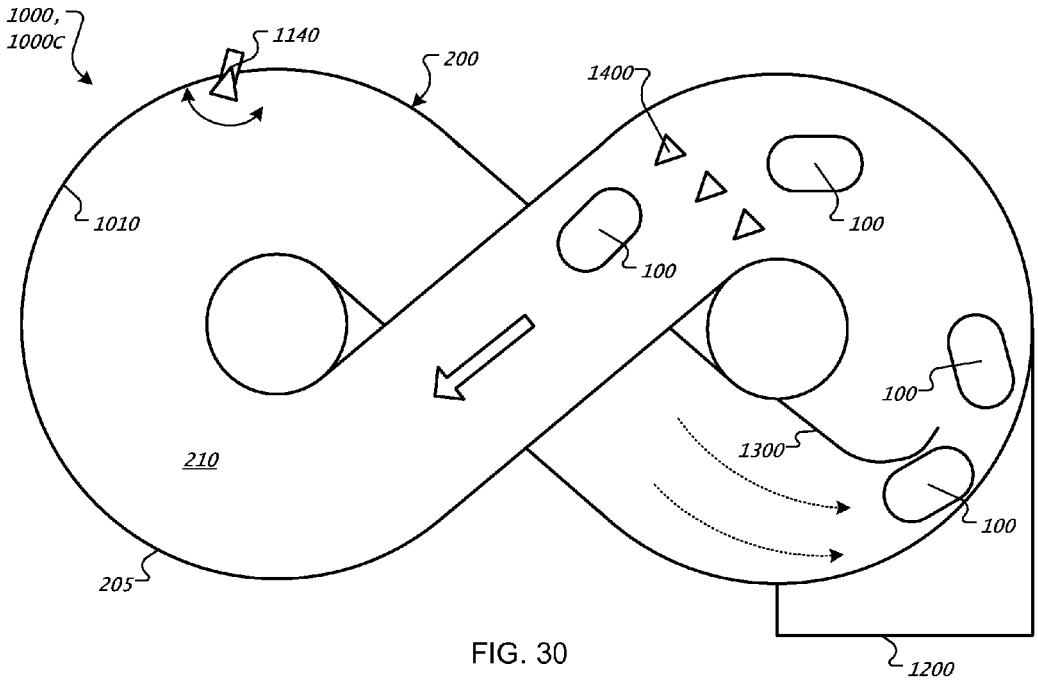
FIG. 30 is a top view of an amusement ride system with an infrastructure having a travel surface defining a figure-eight track.

Referring to FIGS. 28-30, an amusement ride infrastructure 1000 includes a track or way having a travel surface 210 defined by the support layer 205, as described above, supporting one or more vehicles 100, as described above. Examples of suitable tracks 1000 include, but are not limited to, a rectangular area 1000A, as shown in FIG. 28, a substantially oval track 1000B, as shown in FIG. 29, and a figure-eight track 1000C, as shown in FIG. 30. In one example, a 5000 square foot track 1000 accommodates between about 30-40 vehicles. The track 1000 may include walls 1010 to confine the vehicles 100 on the track 1000. The track 1000 may include a passenger loading/unloading area 1200, which provides an ingress and egress from the track 1000 as well as access to the vehicles 100 for passengers to get in/on and ride the vehicles 100 and depart from the vehicles 100.

In some examples, the track 1000 includes a course diverter 1300 which diverts a travel direction of the vehicles 100. The course diverter 1300 is typically a rail or wall used to divert the travel direction of the vehicles 100 toward the passenger loading/unloading area 1200. A conveyer belt 1350 may be used to carry vehicles 100 through the loading/unloading area 1200 for passenger loading and unloading. The conveyer belt 1350 may be a rubber belt or other non-skid/non-slippery material conducive for safely walking on. The conveyer belt 1350 can be used to pull and eject vehicles 100 from and onto the track 1000.

In some implementations, the track 1000 includes a vehicle advancer 1400 disposed on the track wall 1010 or travel surface 210, as shown in FIGS. 29-30. In some implementations, the vehicle advancer 1400 can be adjusted among various positions to influence a desired travel direction the vehicle 100. The vehicle advancer 1400 may be a fluid jet discharging fluid 400 or a driven roller (e.g. rubber roller or wheel) configured to contact and engage (e.g. by friction) the undersurface 115 of a vehicle 100 that propels the vehicle 100. The vehicle advancer 1400 can be used to divert the travel direction of the vehicle 100 or propel the vehicle 100 up, down, or along the track 1000. In some examples, the vehicle advancer 1400 includes a bucket of water spilled on to the track 1000 to move vehicles 100 about the track 1000.

In some implementations, the track 1000 is configured as an obstacle course having multiple course diverters 1300 and vehicle advancers 1400 arranged to move or guide the vehicles 100 about the track 1000 (e.g. a large-scale pinball table). For example, a vehicle 100 may be guided down a path by a course diverter 1300 toward one or mere vehicle advancers 1400 that move the vehicle 100 in an unexpected direction toward another path.

The amusement park water ride system 10, 1000 described above advantageously allow riders to experience the fun of water with the comfort and safety of being on a supported surface (e.g. in contrast to deeper water having drowning hazards or elevated rides, like roller coasters). In the examples illustrated in FIGS. 28-30, participants drive or race multiple vehicles 100 around the track 1000 and bump into each other. One or more people can drive each vehicle 100. The participants may all start and finish at the same time or participants may individually be changed out at the passenger loading/unloading area 1200. Vehicles 100 equipped with water guns 140 allow riders to shoot water at each other. In some examples, the track 1000 is equipped with water guns 1140 (or fluid guns) rotatable about a range of motion that allows spectators to spray passing riders with water and providing a family entertainment event.

A number of implementations have been described. Nevertheless, it will be understood that various modifications may be made without departing from the spirit and scope of the disclosure. For example, the valve element operator may be separate from the valve element. Also, the compliant flap employed to assist in containing the cushion of water beneath the vehicle undersurface may be formed of multiple flap elements. The amusement ride systems 10, 1000 described herein may be used to transport people and/or goods from one place to another. It may also be used as a transportation system. Accordingly, other implementations are within the scope of the following claims.

What is claimed is:

1. An amusement ride system comprising:

an amusement ride infrastructure defining a travel surface;

at least one vehicle comprising a vehicle body defining a vehicle undersurface disposed for travel generally along said travel surface;

a plurality of supply valves disposed to selectively deliver a pressurized flow of water through said travel surface, into a confined region defined between said vehicle undersurface and said travel surface, said pressurized flow of water into and through said confined region creating a cushion of water to separate said vehicle undersurface from said travel surface; and a drain valve disposed to drain water from said travel surface, the drain valve comprising: a drain valve body defining at least one inlet port, an exit port, and an interior surface defining a water flow passageway between said at least one inletport and said exit port and a valve seat, said inlet port being exposed at said travel surface;

said vehicle configured to convey at least one passenger generally along said travel surface, upon said cushion of water.

2. The amusement ride system of claim 1, wherein each valve of said plurality of supply valves comprises:

a supply valve body defining at least one inlet port, an exit port, and an interior surface defining a water flow passageway between said at least one inlet port and said exit port and a valve seat, said exit port being exposed at said travel surface;

a supply valve element disposed within said water flow passageway for movement between a first position in sealing engagement with said valve seat and a second position spaced from said valve seat for permitting pressurized flow of water through said exit port; and a supply valve element operator extending above a plane of said travel surface in a position for contact with a vehicle passing over said exit port, vehicle contact with said supply valve element operator causing movement of said supply valve element from said first position to said second position, permitting pressurized flow of water through said exit port into said confined region defined between said vehicle undersurface and said travel surface.

3. The amusement ride system of claim 2, wherein said supply valve element is urged toward sealing engagement with said valve seat by water pressure in said water flow passageway of said supply valve.

4. The amusement ride system of claim 2, wherein said valve element is urged toward sealing engagement with said valve seat by a biasing element.

5. The amusement ride system of claim 1, wherein the drain valve further comprises:

a buoyant drain valve element disposed within said water flow passageway for movement between a first position in sealing engagement with said valve seat and a second position spaced from said valve seat for permitting flow of water through said exit port.

6. The amusement ride system of claim 1, wherein said vehicle further comprises at least one drive assembly housed by said vehicle body and configured to maneuver said vehicle generally along said travel surface.

7. The amusement ride system of claim 6, wherein a lower portion of said vehicle body defines a reservoir cavity and said vehicle undersurface defines at least one aperture in fluid communication with said reservoir cavity, wherein water from said cushion of water enters said reservoir cavity through said aperture.

8. The amusement ride system of claim 7, wherein said drive assembly comprises at least one pump disposed in said vehicle body, said pump having an inlet line in fluid communication with said reservoir cavity and an outlet line configured to discharge in a manner to propel said vehicle generally along said travel surface.

9. The amusement ride system of claim 6, wherein said drive assembly comprises a driven wheel disposed for engagement with said travel surface.

10. The amusement ride system of claim 1, wherein said drive assembly comprises:

a drive housing; and a driven wheel supported by said drive housing operable for movement among a retracted position above said vehicle undersurface and a deployed position at least partially below said vehicle undersurface, disposed for engagement with said travel surface.

11. The amusement ride system of claim 1, wherein said vehicle further comprises at least one compliant flap extending from said vehicle body and generally circumscribing said confined region defined between said vehicle undersurface and said travel surface, said compliant flap serving to augment creation of the cushion of water separating said vehicle undersurface from said travel surface.

12. An amusement ride vehicle for maneuvering over a travel surface upon a cushion of water, the vehicle comprising:

a vehicle body defining a vehicle undersurface disposed for travel generally along the travel surface;

a reservoir cavity by a lower portion of said vehicle body, said vehicle undersurface defining at least one aperture in fluid communication between said reservoir cavity, and said cushion of water, for flow of water from the cushion of water into said reservoir cavity through said aperture under hydrostatic pressure of said vehicle undersurface upon said cushion of water;

at least one onboard water pump having an intake line in fluid communication with said reservoir cavity and an outlet line disposed for discharge of water; and at least one drive assembly housed by said vehicle body and configured to maneuver said vehicle generally along the travel surface.

13. The amusement ride vehicle of claim 12, further comprising at least one compliant flap extending from said vehicle body and generally circumscribing a confined region defined between said vehicle undersurface and the travel surface, said compliant flap serving to augment creation of the cushion of water separating said vehicle undersurface from the travel surface and serving to increase hydrostatic pressure of water flowing into said reservoir cavity.

14. The amusement ride vehicle of claim 12, wherein said drive assembly comprises said as leasty one water pump disposed in said vehicle body, with said outlet line being configured to discharge water from said reservoir cavity in a manner to propel said vehicle generally along the travel surface.

15. The amusement ride vehicle of claim 14, wherein said outlet line is configured to discharge water flow from said reservoir cavity beneath and/or behind the vehicle at a predetermined discharge angle to the travel surface, thereby to propel said vehicle generally along the travel surface.

16. The amusement ride vehicle of claim 14, wherein said vehicle further comprises a steering device associated with and controlling the discharge angle and/or direction of water flow from the outlet line, thereby propel said vehicle generally along the travel surface.

17. The amusement ride vehicle of claim 12, wherein said drive assembly comprises a driven wheel disposed for engagement with the travel surface.

18. The amusement ride vehicle of claim 12, wherein the drive assembly comprises:

a drive housing; and a driven wheel supported by said drive housing operable for movement among a retracted position above said vehicle undersurface and a deployed position at least partially below said vehicle undersurface, disposed for engagement with the travel surface.

19. The amusement ride vehicle of clam 12, wherein said outlet line is configured to discharge water flow from said reservoir cavity through a water gun mounted on said vehicle.

20. An amusement ride infrastructure comprising:

a surface layer defining a travel surface;

a plurality of supply valves disposed in said surface layer, each supply valve comprising:

a supply valve body defining an exit port, at least one inlet port, and an interior surface defining a water flow passageway between said at least one inlet port and said exit port and a valve seat, said exit port being exposed at said travel surface;

a supply valve element disposed within said water flow passageway for movement between a first position in sealing engagement with said valve seat and a second position spaced from said valve seat for permitting pressurized flow of water through said exit port; and a supply valve element operator extending above a plane of said travel surface in a position for contact with a vehicle passing over said exit port, vehicle contact with said supply valve element operator causing movement of said supply valve element from said first position to said second position, permitting pressurized flow of water through said exit port into a confined region defined between an undersurface of said vehicle and said travel surface; and at least one drain valve disposed to drain water from said surface layer, the drain valve comprising:

a drain valve body defining an exit port, at least one inlet port, and an interior surface defining a water flow passageway between said at least one inlet port and said exit port and a valve seat, said exit port being exposed at said travel surface.

21. The amusement ride infrastructure of claim 20, wherein the at least one drain valve disposed to drain water from said surface layer further comprises:

a buoyant drain valve element disposed within said water flow passageway for movement between a first position in sealing engagement with said valve seat and a second position spaced from said valve seat for permitting flow of water through said exit port.

22. The amusement ride infrastructure of claim 1 or claim 21, wherein said supply valve body houses said drain valve.

23. A method of conveying an amusement ride vehicle generally along a travel surface, the method comprising:

placing the vehicle on an amusement ride infrastructure defining said travel surface, the vehicle comprising a vehicle body defining a vehicle undersurface disposed for travel generally along said travel surface;

delivering a pressurized flow of water through said travel surface into a confined region defined between said vehicle undersurface and said travel surface, said pressurized flow of water into and through said confined region creating a cushion of water to separate said vehicle undersurface from said travel surface;

delivering a flow of fluid from said cushion of water into a reservoir cavity defined in a lower portion of said vehicle body, the flow of water passing through at least one aperture disposed in fluid communication with said reservoir cavity; and maneuvering the vehicle over said travel surface.

24. The method of claim 23, wherein the pressurized flow of water is delivered through a plurality of selectively disposed supply valves, each valve of said plurality of supply valves comprising:

a supply valve body defining an exit port, at least one inlet port, and an interior surface defining a water flow passageway between said at least one inlet port and said exit port and a valve seat, said exit port being exposed at said travel surface;

a supply valve element disposed within said water flow passageway for movement between a first position in sealing engagement with said valve seat and a second position spaced from said valve seat for permitting pressurized flow of water through said exit port; and a supply valve element operator extending above a plane of said travel surface in a position for contact with a vehicle passing over said exit port, vehicle contact with said supply valve element operator causing movement of said supply valve element from said first position to said second position, permitting pressurized flow of water through said exit port into said confined region defined between said vehicle undersurface and said travel surface.

25. The method of claim 23, wherein said vehicle further comprises at least one drive assembly housed by the vehicle body and configured to maneuver said vehicle generally along said travel surface.

26. The method of claim 25, wherein said drive assembly comprises at least one pump disposed in said vehicle body, said pump having an inlet line in fluid communication with said reservoir cavity and an outlet line configured to discharge in a manner to propel said vehicle generally along said travel surface.

27. The method of claim 25, wherein said drive assembly comprises:

a drive housing; and a driven wheel supported by said drive housing operable for movement among a retracted position and a deployed position relatively more extended below said vehicle undersurface and disposed for engagement with said travel surface.

28. The method of claim 23, wherein said vehicle further comprises at least one compliant flap extending from said vehicle body and generally circumscribing said confined region defined between said vehicle undersurface and said travel surface, said compliant flap serving to augment creation of the cushion of water separating said vehicle undersurface from said travel surface.

* * * * *

UNITED STATES PATENT AND TRADEMARK OFFICE

CERTIFICATE OF CORRECTION

PATENT NO. : 7,896,752 B2
APPLICATION NO. : 11/936199
DATED : March 1, 2011
INVENTOR(S) : Lance Yule It is certified that error appears in the above-identified patent and that said Letters Patent is hereby corrected as shown below:

Column 12, Line 34, in Claim 1, delete “inletport” and insert -- inlet port --, therefor.

Column 13, Line 42, in Claim 12, delete “cavity” and insert -- cavity defined --, therefor.

Column 14, Line 2, in Claim 14, delete “as leasty” and insert -- at least --, therefor.

Signed and Sealed this
Seventeenth Day of May, 2011

David J. Kappos

David J. Kappos
*Director of the United States Patent and Trademark Office*